US011136213B2

(12) United States Patent
Russell et al.

(10) Patent No.: US 11,136,213 B2
(45) Date of Patent: Oct. 5, 2021

(54) SELF-STOWING CABLE DISPENSER FOR FIGURE EIGHTING

(71) Applicant: Triple C Manufacturing, Inc., Sabetha, KS (US)

(72) Inventors: Jay R. Russell, Sabetha, KS (US); Galen R. Ackerman, Sabetha, KS (US); Edwin J. Strathman, Bern, KS (US)

(73) Assignee: Triple C Manufacturing, Inc., Sabetha, KS (US)

( * ) Notice: Subject to any disclaimer, the term of this patent is extended or adjusted under 35 U.S.C. 154(b) by 0 days.

(21) Appl. No.: 16/572,596

(22) Filed: Sep. 16, 2019

(65) Prior Publication Data

US 2020/0087102 A1 Mar. 19, 2020

Related U.S. Application Data

(60) Provisional application No. 62/732,355, filed on Sep. 17, 2018.

(51) Int. Cl.
*B65H 57/18* (2006.01)
*B65H 75/30* (2006.01)
*B65H 49/34* (2006.01)

(52) U.S. Cl.
CPC ..... *B65H 57/18* (2013.01); *B65H 49/34* (2013.01); *B65H 75/30* (2013.01)

(58) Field of Classification Search
CPC ..... B65H 57/12; B65H 57/14; B65H 57/18; B65H 75/30; B65H 49/34; B65H 2701/32; B65H 49/325; B65H 49/327; B65H 49/32; B65H 49/321; B65H 54/74; B65H 2555/12; B65H 2555/22
See application file for complete search history.

(56) References Cited

U.S. PATENT DOCUMENTS 2,313,514 A * 3/1943 Brooks ..... B60P 1/483 414/424
2,679,987 A * 6/1954 Saliba ..... B65H 54/42 242/393
2,780,419 A * 2/1957 Hall ..... F16D 49/08 242/421.3
2,848,123 A * 8/1958 Keys ..... B60P 3/035 414/549

(Continued)

OTHER PUBLICATIONS

Brooks Brothers Trailers, Fiber Optic Trailer, Apr. 3, 2018, Troy, MO.

(Continued)

*Primary Examiner* — William A. Rivera
(74) *Attorney, Agent, or Firm* — Coughlin Law Office, LLC; Daniel J. Coughlin; Stuart M. Aller

(57) ABSTRACT

A method and apparatus for engaging a cable from a reel having a reel axle, such as for dispensing the cable from the reel with a motor assembly to figure eight a fiber optic cable sensitive to twisting. An adjustable frame is mounted to a first lifting arm. The adjustable frame is stored in a self-stowed configuration wherein the adjustable frame is vertically stacked parallel to the first lifting arm. The adjustable frame is deployed to align a distal frame end of the adjustable frame near the horizontal center of the reel in a plurality of lifting arm pivot positions.

20 Claims, 27 Drawing Sheets

(56) References Cited

U.S. PATENT DOCUMENTS 2,867,390 A * 1/1959 Anrig ..... B65H 49/32 242/422.8
2,941,678 A * 6/1960 Keys ..... B60P 3/035 414/546
3,063,584 A 11/1962 Joseph et al.
3,931,902 A * 1/1976 Love, Jr. ..... B60P 3/035 414/458
4,454,999 A * 6/1984 Woodruff ..... B65H 49/34 242/388.7
4,588,142 A * 5/1986 Malzacher ..... B65H 54/2812 242/390.5
4,657,165 A 4/1987 Giroux
4,762,291 A * 8/1988 Sauber ..... B60P 3/035 242/559
4,767,073 A * 8/1988 Malzacher ..... B65H 54/2812 242/397.3
4,779,784 A 10/1988 Giroux
5,139,751 A * 8/1992 Mansfield ..... B05B 13/06 118/306
5,332,166 A * 7/1994 Kepes ..... B65H 54/42 242/390.2
5,402,959 A * 4/1995 Wadle ..... B65H 54/2896 242/386
5,486,084 A * 1/1996 Pitman ..... B60P 1/5433 188/171
5,897,073 A * 4/1999 McVaugh ..... B60P 3/035 242/390.5
6,932,294 B1 8/2005 Larson
9,016,609 B2 * 4/2015 Turner ..... B65H 75/42 242/390.5
9,187,289 B1 * 11/2015 Jordan ..... B65H 49/325
10,150,402 B2 * 12/2018 White ..... B60P 1/16
10,654,395 B1 * 5/2020 White ..... B60P 3/035
10,723,254 B2 * 7/2020 Barnett ..... B62D 63/061
10,745,237 B2 * 8/2020 Russell ..... B65H 75/4481
2006/0086862 A1 * 4/2006 Konkel ..... B65H 49/327 242/594.5
2009/0196723 A1 * 8/2009 Smith ..... B65H 49/38 414/546
2015/0158692 A1 * 6/2015 Reynolds ..... B60P 1/483 242/390.2

OTHER PUBLICATIONS

Larson Cable Trailers, Inc., Owner/Operator Manual for the Larson Cable Trailers Model 5600 / Model 5700, Apr. 1, 2007, Huron, South Dakota.

* cited by examiner

SELF-STOWING CABLE DISPENSER FOR FIGURE EIGHTING

CROSS REFERENCES

This application claims the benefit of U.S. Provisional Application No. 62/732,355, filed 17 Sep. 2019.

FIELD OF THE INVENTION

The present disclosure relates to devices for dispensing reelable material such as cable, wire, rope or other reelable material from a reel unit mounted on a vehicle adapted to transport and carry reel units on lifting arms. The present disclosure also relates to methods for dispensing the reelable material into a figure eight pattern to access a terminal portion of the reelable material.

BACKGROUND OF THE INVENTION

Self-loading bed assemblies for flat-bed trucks are useful for adapting a truck to pick-up, transport, and then feed or off-load one or more big round bales, as shown in U.S. Pat. No. 4,564,325. The actuating mechanism for the lifting arms is located underneath the bed, and the lift arms are designed to pivot between a stored position where the arms are positioned on the top surface of the bed and an extended position for loading and unloading the cargo that is positioned on the ground.

As disclosed in U.S. patent application Ser. No. 15/939,498, a flat-bed truck with a reel lift apparatus can lift, carry, and transport a spool or a reel unit. The reel lift apparatus can also comprise a driven wheel that engages the reel by sliding adjacent to and alongside the lifting arm to turn the reel for retrieving or dispensing the reelable material.

When installing cables—such as fiber optic cables—installers encounter obstacles such as roads and rivers. In order to feed the cable beneath the obstacle, the terminal end of the spooled cable is obtained. Cable reels containing fiber optic cables (also known as drums or spools) are often supplied with 4-kilometers of cable. The cable is completely dispensed to obtain its terminal end previously on the reel. Once the terminal end is obtained, the terminal end is drawn beneath the obstacle and the reelable material is re-spooled onto the reel. The figure-eight configuration prevents kinking or twisting of the cable when the cable is unreeled or backfed. The cable may be dispensed onto the ground in the figure eight shape in order to obtain the terminal end. Figure eighting may be performed manually in order to prevent damage to the cable from torsion, tension, and bend radii limitations for the cable. The figure eight puts a half twist in on one side of the "8" and takes it out on the other, preventing twists. Each loop is commonly 5 feet to 12 feet in diameter.

SUMMARY OF THE INVENTION

We disclose a self-stowing cable dispensing mechanism to rapidly payout the reelable material in a figure eight formation. The cable dispensing mechanism retracts to a position that is compatible with the other functions of the reel lift assembly. For example, the stowed cable dispensing mechanism does not interfere with the reel lift assembly's ability to lift, carry, dispense, or retrieve the cable. The self-stowing cable dispensing mechanism may also decrease the time to obtain the terminal end of the cable by making the cable dispensing mechanism always available. For example, if the dispensing mechanism needs to be installed or brought over on a separate trailer, then each of those steps results in downtime for the crew installing the line. By self-stowing the cable dispensing mechanism, the dispensing mechanism can be rapidly deployed. By rapidly deploying a rapid dispensing solution, the total time to figure eight a cable may be dramatically reduced.

Another advantage of the current disclosure is that the cable dispensing mechanism can be positioned behind the reel with the reel in any vertical position. The primary arm is pivotally attached to the reel axle mount assembly so that the primary arm pivots about an axis parallel to the reel axle. By attaching the primary arm to the lifting arm, the primary arm moves relative to the lifting arm. The linear actuator pushes the slide along the longitudinal axis of the lifting arm. The slide drives the support to radially position the primary arm relative to the reel. The primary arm allows the cable dispensing mechanism to be positioned vertically relative to the pivot positions of the lifting arms. In this way, the cable can be dispensed in multiple reel lift positions.

We also discovered that the cable dispensing mechanism can be positioned in the center of the reel in the reel axle axis. The cable dispensing mechanism can be positioned in the center of a single reel mounted upon the lifting arms. The cable dispensing mechanism can also be centrally positioned behind a reel when multiple reels are mounted upon the lifting arms by moving the cable dispensing mechanism on the payout arm. The payout arm pivots on the free moving end of the primary arm and pivots about an axis tangential to the arc defined by movement of the free end of the primary arm. The free moving end of the primary arm is distal from the end mounted to the lifting arm.

In order to position the primary arm, the primary arm is mounted to a slide that travels on the second lifting arm. Activating a linear actuator—such as a lead screw—causes the slide to move longitudinally along a rail mounted to the lifting arm. When the primary arm reaches the desired height, the users stops activating the linear actuator.

We also recognized that increasing the height of the cable dispensing mechanism may result in an improved figure eight pattern. The lifting arms can lift the reel above the bed of the vehicle. The cable dispensing mechanism may be raised to the height of the reel axle or higher than the reel axle. Further, the cable dispensing mechanism can be tilted about a horizontal axis such that the payout tube is at an upward angle relative to horizontal.

Another advantage of the present disclosure is that the cable can be dispensed in multiple lifting arm positions. By mounting the cable dispensing mechanism upon an adjustable frame mounted directly to the lifting arms, the adjustable frame positions the cable dispensing mechanism relative the lifting arm position. In this way, the cable dispensing mechanism maintains its proximity to the reel in any lift position. For example, the lift arms can be fully extended, positioning the reel directly behind the truck, and depending on the length of the support connecting the slide to the lifting arm, the cable dispensing mechanism can be aligned behind the reel. Alternatively, the lift arms can position the reel just above the bed surface, and the cable dispensing mechanism can be positioned using the adjustable frame such that the cable dispensing mechanism is properly positioned for dispensing cable from the reel.

It may be advantageous to remove the cable drive mechanism. The cable drive mechanism may be removably mounted to a mounting bracket located at the free end of the payout arm. The cable drive mechanism may be mounted with a post extending downwardly from the motor assembly.

The post is received into the mounting bracket at the free end of the payout arm. A pin may secure the post within the mounting bracket. The power source may then be connected to the motor.

We also recognize that it may be advantageous to pivot the motor assembly about an axis parallel to the reel axis. In this way, the payout tube can be pivoted to point upward, downward, or horizontal in multiple lifting arm pivot positions. This pivoting allows the cable drive assembly to be properly directed regardless of the position of the lifting arms, since the cable drive assembly is mounted via the adjustable frame to the lifting arms. As the lifting arms pivot, the cable dispensing mechanism rotates with the lifting arms.

We also recognized that self-stowing of the payout arm parallel with the lifting arm allows the figure eighting device to be stored in a position ready to deploy without interfering with other operations of the lifting arms or the truck bed. We also recognized that self-stowing of the payout tube parallel with the lifting arm similarly facilitates storing the figure eighting device in a position ready to deploy without interfering with other operations of the lifting arms or the truck bed.

It is understood that other embodiments will become readily apparent to those skilled in the art from the following detailed description, wherein various embodiments are shown and described by way of illustration only. As will be realized, the concepts are capable of other and different embodiments and their several details are capable of modification in various other respects, all without departing from the spirit and scope of what is claimed as the invention. Accordingly, the drawings and detailed description are to be regarded as illustrative in nature and not as restrictive.

BRIEF DESCRIPTION OF DRAWINGS

Aspects are illustrated by way of example, and not by way of limitation, in the accompanying drawings, wherein.

DETAILED DESCRIPTION

Figure 1:
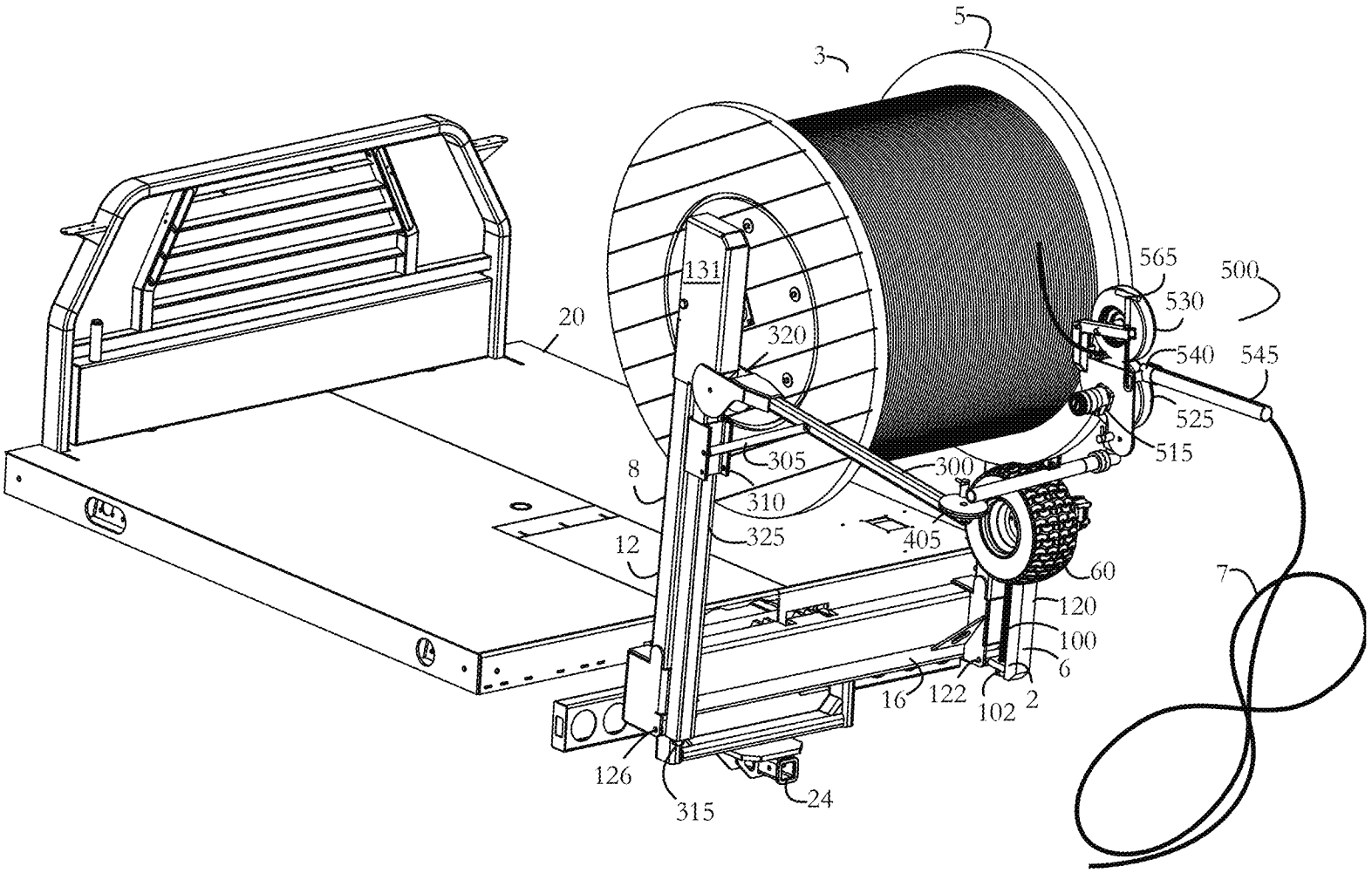
FIG. 1 depicts a rear side perspective view of an embodiment of the cable dispensing mechanism with the adjustable frame in an extended configuration with a reel engaged by the lifting arms.

In order to dispense cable 7 from the reel 3, the motor assembly 500 is positioned on the dispensing side of the reel. As illustrated in FIG. 1, the reel lift apparatus has a first lifting arm 2 and a second lifting arm 8. The reel 3 is mounted to the free moving ends of the lifting arms with the reel axle extending between the first axle slot assembly 130 and the second axle slot assembly 131. The reel 3 may be raised above the vehicle bed 20, in the orientation shown in FIG. 1, with the lifting arms 2, 8 raised perpendicular to the vehicle bed 20.

To dispense the cable (or other reelable material), the payout arm 400 is pivoted to a horizontal position perpendicular to the primary arm 300. The motor assembly 500 is mounted to the free moving distal end of the payout arm 400. The motor assembly 500 is centrally positioned at a radial distance from the reel axle that extends between the first axle slot assembly 130 and the second axle slot assembly 131. The cable 7 (or other reelable material) is pulled off the reel 3 by means of the tractor drive mechanism. The tractor drive mechanism comprises the driven wheel 525 and the idler wheel 530, where the two wheels are in contact with one another and the cable 7 passes therebetween. The cable 7 is directed through a payout tube 545 to fall to the ground in to a figure eight pattern.

Figure 2:
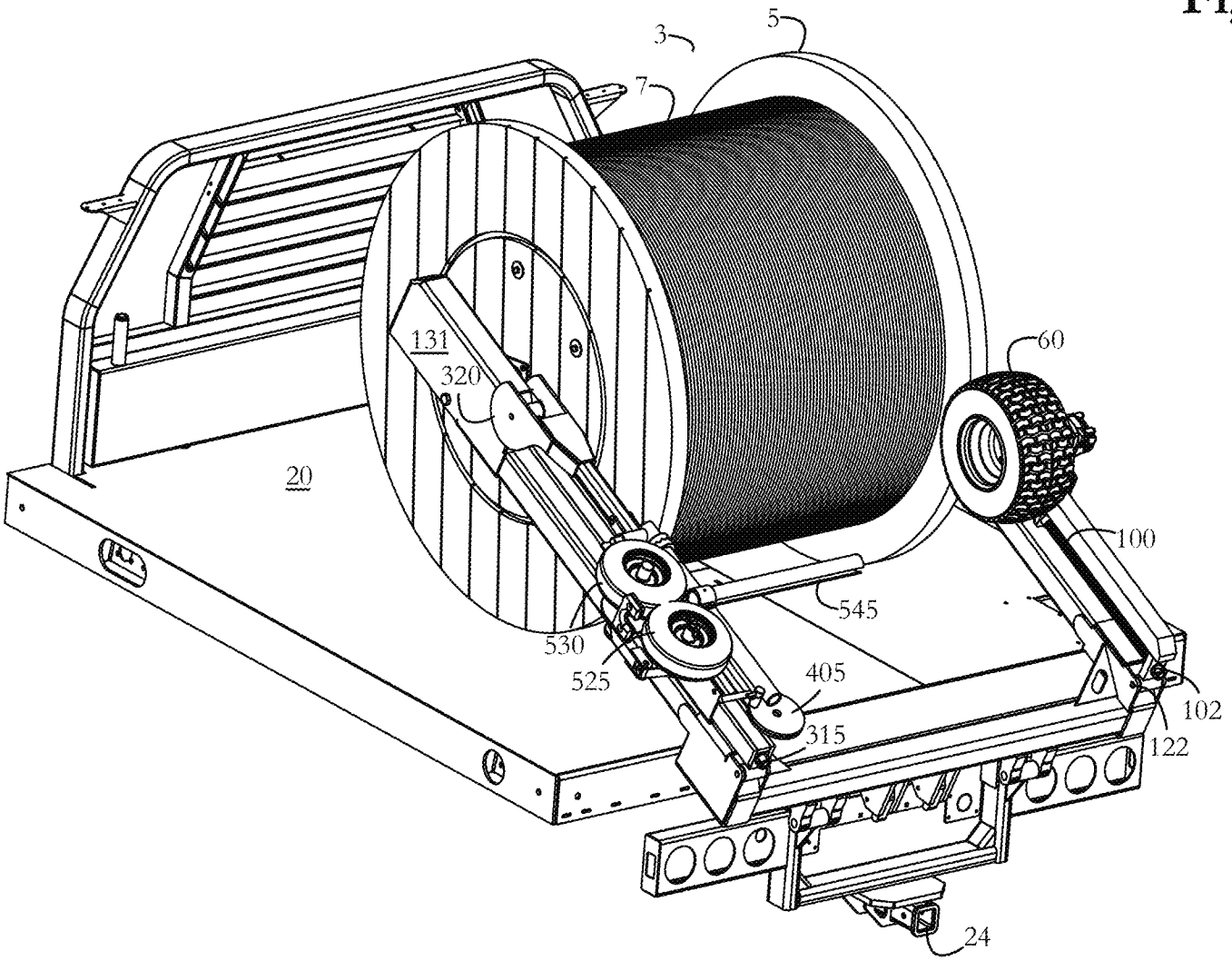
FIG. 2 depicts a rear side perspective view of an embodiment of the cable dispensing mechanism with the adjustable frame in a self-stowed configuration with a reel engaged by the lifting arms, the reel stowed upon the truck bed.

The cable dispensing mechanism is self-stowing inline with a lifting arm 8 for fast deployment when the cable 7 needs to be dispensed into a figure eight, as shown in FIG. 2. In FIG. 2, the reel 3 is oriented in a stored position where the reel 3 rests on the vehicle bed 20. The rewind/traction driven wheel 60 is shown engaged with the rim 5 of the reel 3, the rewind/traction driven wheel 60 is engaged or disengaged with the rim 5 of the reel 3 by moving the rewind/traction driven wheel 60 along rail 120 via the linear actuator 100. The linear actuator 100 drives carriage slide 70 upon which the rewind/traction driven wheel 60 is mounted. The rewind/traction driven wheel 60 is removably mounted to the lifting arm by fastener 122 and fastener 121. Rail 120 is raised above the lifting arm 2 by post 124. In the self-stowed position, the payout arm 400 and the primary arm 300 are vertically stacked parallel to the secondary lifting arm 8.

Figure 3:
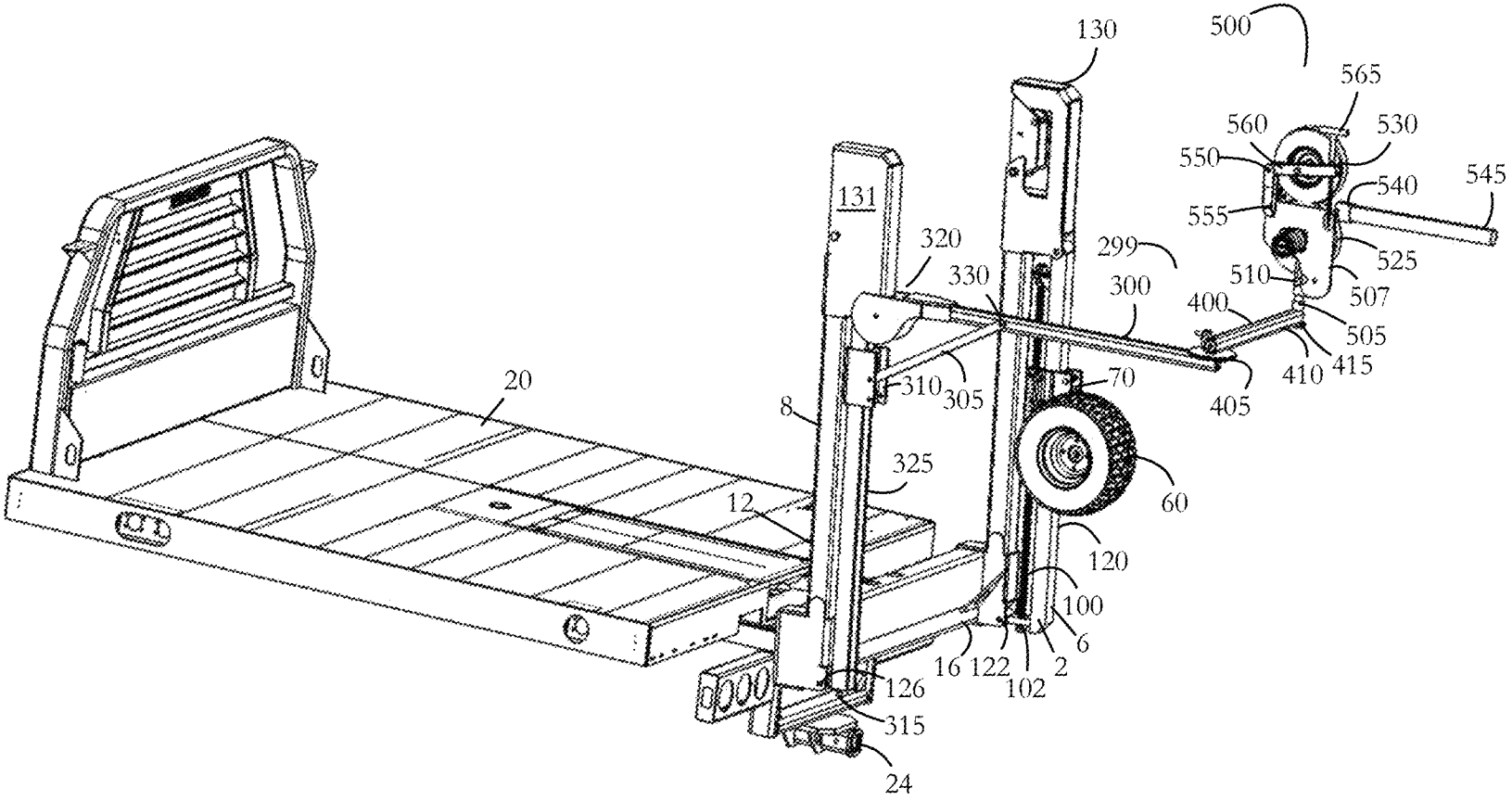
FIG. 3 depicts a side perspective view of an embodiment of the cable dispensing mechanism with the adjustable frame in an extended configuration.

FIG. 3 depicts the lifting arms 2, 8 raised perpendicular to the vehicle bed 20. The adjustable frame 299 is shown in an extended configuration with the primary arm 300 horizontally oriented perpendicular to the lifting arm 8. The payout arm 400 is pivoted to a horizontal position perpendicular to the primary arm 300. The motor assembly 500 is mounted to the free moving distal end of the payout arm 400. The motor assembly 500 is centrally positioned at a radial distance from the reel axle that extends between the first axle slot assembly 130 and the second axle slot assembly 131.

Figure 5:
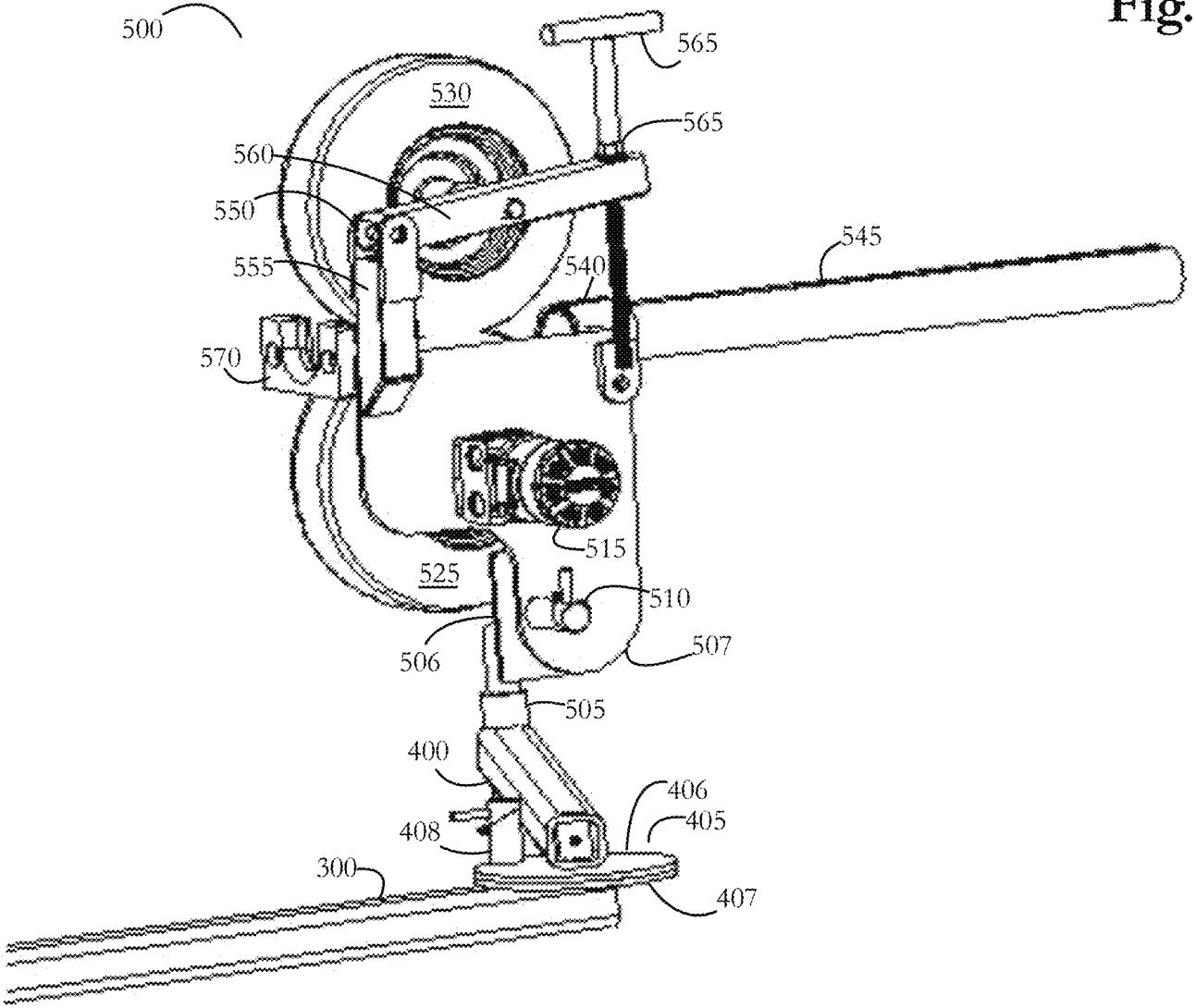
FIG. 5 depicts an enlarged view of a cable dispensing mechanism of the embodiment of FIG. 3.
Figure 6:
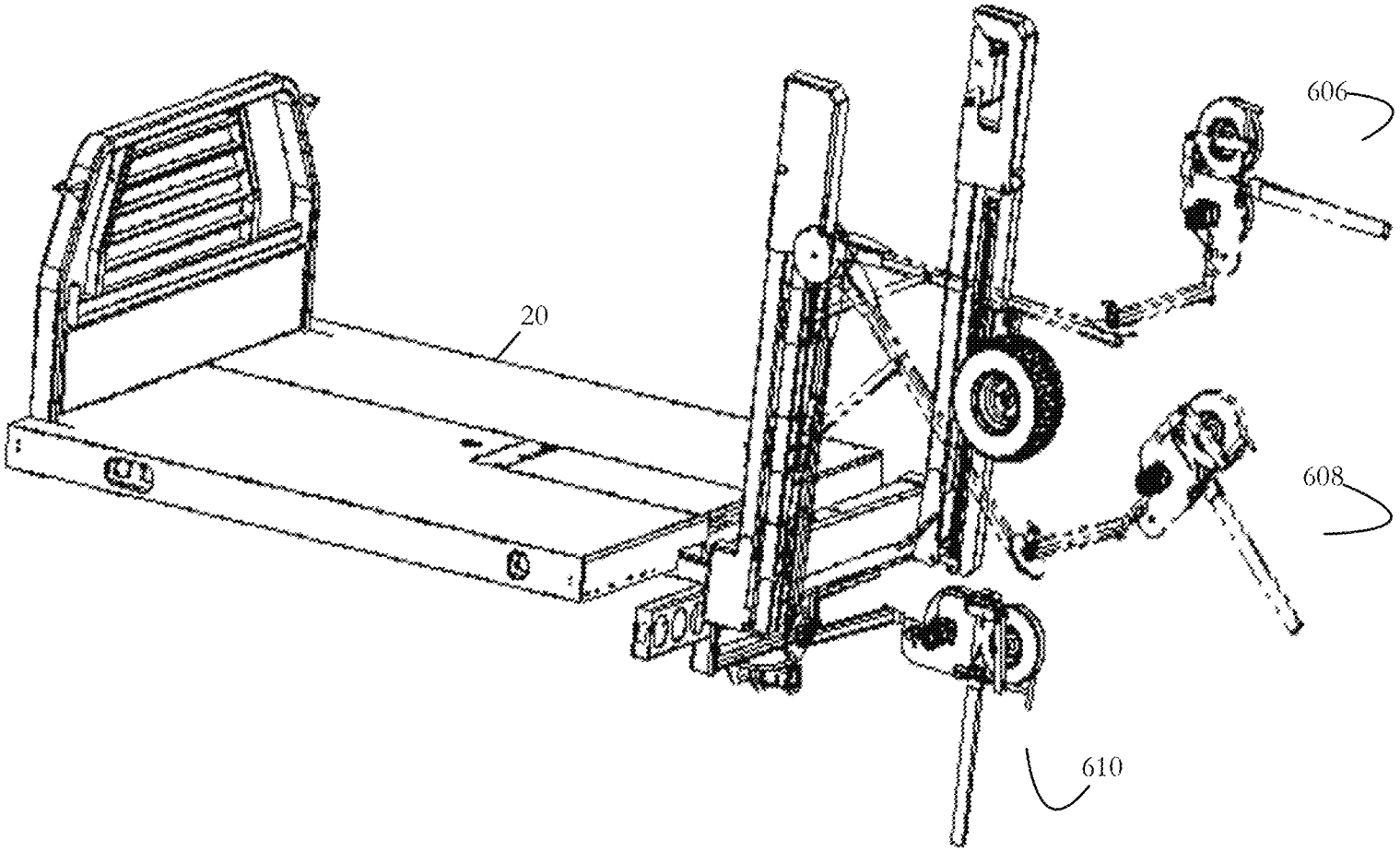
FIG. 6 depicts movement of the primary arm of the embodiment of the adjustable frame of FIG. 3.

The lifting arms 2, 8 are pivotally mounted to the vehicle through the perpendicular mount to a cross member 16. The lifting arms 2, 8 are pivotally mounted to the vehicle at a pivot mount, allowing the arms to pivot relative to the bed through a plurality of pivot positions, as shown in FIGS. 1, 5, and 6. For example, the lifting arms 2, 8 can be pivoted perpendicular to the bed 20 in a retracted lifting arm pivot position, this is shown in FIG. 5. The lifting arms 2, 8 can also be pivoted to an acute angle relative to the bed 20 in a reel loaded pivot position with the reel resting on the bed 20. The lifting arms 2, 8 can also be pivoted to a generally perpendicular angle relative to the bed 20 in an upright pivot position with the lifted vertically above the bed 20 as shown in FIG. 1. The lifting arms 2, 8 can also be pivoted to an obtuse angle relative to the bed 20 in an extended pivot position with the reel extending behind the vehicle, as shown in FIG. 6. The reel lift apparatus can be configured to be continuously pivoted by pivoting the lifting arms 2, 8, the listed pivot positions are provided as example locations of the various pivot points.

Attached to the cross member 16, the lifting arms 2, 8 form a U-shape. The cross member 16 extends across the lateral width of the bed and forms the base of the U-shape. The first lifting arm 2 and the second lifting arm 8 extend perpendicularly from the cross member 16. The first lifting arm 2 has a first distal arm portion 4 and a first proximal arm portion 6, where the first proximal arm portion 6 is mounted to the cross member 16. The second lifting arm 8 has a second distal arm portion 10 and a second proximal arm portion 12, where the second proximal arm portion 12 is mounted to the cross member 16. Each of the lifting arms 2,8 has a respective longitudinal axis generally parallel to the long dimension of the arm.

In the extended position, the cross member 16 is higher than the arms 2, 8. In the retracted position, the cross member 16 can be flush with the bed surface 20. The arms 2,8 lay on top of the bed surface 20 in the unloaded travel position.

The lifting arms 2,8 are depicted as having a rectangular cross section. The lifting arms 2,8 can have a square, rectangular, circular, or otherwise curved cross section. The lifting arms can be made of iron, steel, aluminum, or other sufficiently strong material. The lifting arms 2,8 can be directly welded upon the cross member 16. Alternatively, the lifting arms 2,8 can be removably mounted to the cross member 16 with a mounting bracket. The mounting bracket can be bolted to the cross member 16.

In order to position the motor assembly for dispensing the cable, the adjustable frame 299 is mounted to the second lift arm. The adjustable frame 299 is pivotally mounted with a primary pivot mount 320 near the position where the reel axle is received into the second axle slot assembly 131. As such, the primary arm 300 rotates generally radially from the reel axle in any of the lift arm 2, 8 pivot positions. By rotating radially about the reel axle, the primary arm angle 303—the angle between the primary arm 300 and the secondary lifting arm 8—can be increased or decreased to match the lifting arm angle—the angle between the vehicle bed 20 and the second lifting arm 8. Generally, the payout arm 400 rotates about an axis tangential to the arc defined by the rotational movement of the motor assembly 500. When the primary arm angle 303 is the same as the secondary lifting arm angle, then the payout arm 400 will rotate about a generally vertical axis.

In order to vertically stack inline with the secondary lifting arm 8, the primary arm 300 is lowered to extend along the length of the secondary lifting arm 8. This orientation is shown in FIG. 5. The primary arm 300 is illustrated as having a primary arm length approximately equal in length with the lifting arm length of the secondary lifting arm 8 between the mounting point at the cross member 16 and the second axle slot assembly 131.

In order to pivot the primary arm 300 into position, the primary arm is pivotally mounted on a primary pivot mount 320. The primary pivot mount 320 is a bracket having a hollow center portion and rounded side portions. The hollow center portion prevents the primary pivot mount 320 from interfering with the second lift arm 8 during rotation. The rounded side portions allow the primary arm 300 to rotate without creating any pinch points. The primary arm 300 is securely received into a sleeve of the primary pivot mount 320.

Figure 4:
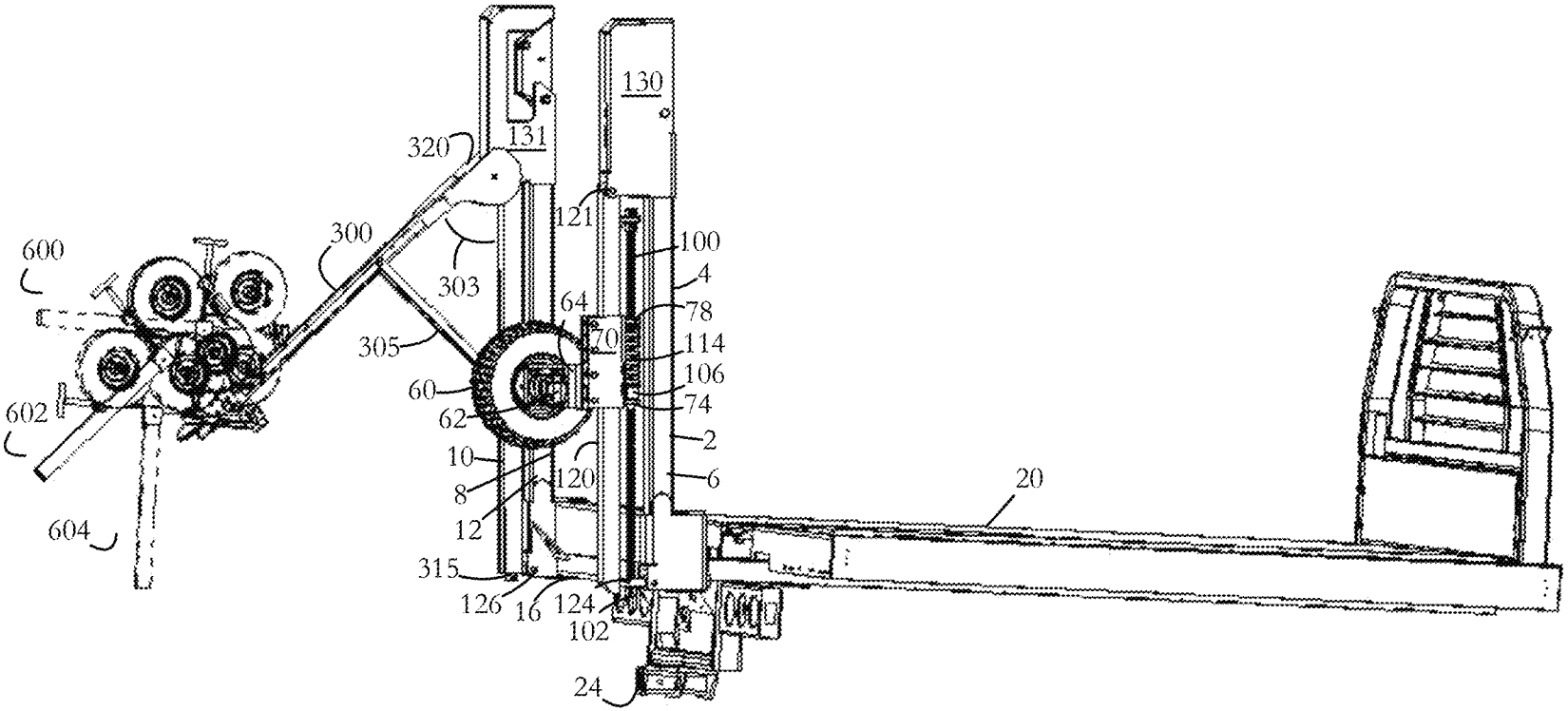
FIG. 4 depicts movement of the cable dispensing mechanism of FIG. 3 pivoting about an axis horizontal to the longitudinal axis of the reel axle.

The primary arm 300 is pivoted into position by operation of the slide control 315. The slide control comprises a linear drive mechanism operably connected to a slide 310 mounted to a rail 325. The slide 310 drives the pivoting of the primary arm 300 through the support arm 305. The linear drive mechanism of the slide control 315 may be mounted to the rail 325. The linear drive mechanism can comprise a lead screw, spindle drive, belt drive, toothed belt, linear actuator, or a linear motor. A linear motor can comprise any device capable of generating linear motion. The power source for the linear drive mechanism can be electric, hydraulic, pneumatic, or manual. The lead screw could be disposed within the rail 325 or within the secondary lifting arm 8 or adjacent to either the rail 325 or the secondary lifting arm 8. As the slide control 315 pushes the slide 310 toward the primary pivot mount 320, the support 305 pivots between the slide and the primary arm mount position 330. As shown in FIG. 4, the primary arm 300 moves between a primary arm lowered configuration 610, to a primary arm midway configuration 608, to a primary arm raised configuration 606 when the slide control 315 pushes the slide 310 toward the primary pivot mount 320. The linear drive mechanism could be positioned inside of the rail 325 or inside of the lifting arm 2, 8. Alternatively, the linear drive mechanism can be disposed adjacent to the rail 325 or the lifting arm 2, 8. The rail is shown mounted to the lifting arm via fastener 126.

The primary arm 300 pivots when the slide 310 moves along the rail 325. The rail 325 is shown mounted parallel to the longitudinal axis of the secondary lifting arm 8. The rail 325 can be mounted to the distal rail mount and the proximal rail mount 322. The rail may be mounted in close proximity to the secondary lifting arm 8 when the linear drive mechanism is mounted internal to the rail. Alternatively, and as illustrated with the primary lifting arm, the rail can be offset from the lifting arm. The offset is determined by the height of the rail support. The distal end of the rail is mounted to the proximal rail mount located at the second axle slot assembly 131. The rail 325 is shown as generally the same length of the secondary lifting arm 8. As such, the sliding rail 325 does not up any additional bed space relative to the secondary lifting arms 8. The rail 325 is depicted as having a rectangular cross section, such as a square iron pipe. The rail 325 can have a square, rectangular, circular, or otherwise curved cross section. The rail can be made of iron, steel, aluminum, or other sufficiently strong material. The rail 325 can be removably mounted to the lifting arms 2,8. Alternatively, the rail 325 can be directly welded to the lifting arms 2,8. Alternatively, the rail 325 can be mounted—either removably or permanently—to the cross member 16 adjacent to the second lifting arm 8.

Alternatively, the sleeve can be slidably mounted to a respective lifting arm 2,8. In this way, a separate rail 325 would not be needed, and the slide 310 would instead travel longitudinally along the respective lifting arms 2, 8. The slide 310 would receive the respective lifting arm 2, 8 in the same way the illustrated embodiment receives the rail 325.

The slide 310 transfers the motion of the slide control 315 to the primary arm 300 through the support 305. As illustrated in FIG. 1, a slide 310 is mounted to the rail 120. The slide 310 is shown as a rectangular pipe. The internal dimensions of the opening in the slide 310 correspond to the external dimensions of the rail 325. The slide 310 is depicted as a rectangular pipe with an internal opening having a width and height that corresponds to the width and height of the rail 325. The slide 310 has a cross section that corresponds with the cross section of the rail 325. In an alternative embodiment where the slide 310 travels along the secondary lifting arm 8, the slide 310 has an internal opening that corresponds with the width, height, and cross section of the secondary lifting arm 8. The inside surface of the slide 310 may be configured with an inner sleeve 312 made of a low friction material such as ultra-high molecular weight (UHMW) plastic. The inner sleeve 312 facilitates movement of the slide 310 upon the rail 325. Alternatively, the inner sleeve 312 may comprise ball bearings or other technology known in the art to reduce friction during linear movement.

In addition to the slide as illustrated, alternate embodiments of the slide mechanism are contemplated. Alternatively, the slide mechanism comprises an insert element configured to slide within the rail or within a lifting arm 2,8. For example, the slide 310 may be mounted within the rail 325. An upper portion of the slide 310 could extend through a slot in the rail 325, thereby providing similar movement to the support 305. In another embodiment, the slide apparatus comprises a rail guide system. In a rail guide system, the rail 325 is keyed such that a linear bearing is capable of longitudinally sliding on the rail. To that effect, the rail 325 could have a square cross section or a circular cross section with a notch, groove, bump, bulge, or blip that corresponds to a corresponding keyed linear bearing. A commercially available example of this type of slide mechanism is the IGUS DryLin® line of sliders. The sliders can comprise ball bearings or plastic linear guides.

The slide control 315 may comprise a lead screw extending along the length of the rail 325. The lead screw is a threaded shaft used to convert rotation to longitudinal motion. A turning mechanism is mounted to the proximal end of the rail 325 near the location where the secondary lifting arm 8 is mounted to the cross member 16. As illustrated, the turning mechanism can be a hexagonal nut secured to the lead screw, such that turning the nut results in moving the slide, as the slide is operably connected to the lead screw. The lead screw may be disposed generally parallel to the rail 325 and the respective lifting arm 2, 8.

The turning mechanism is illustrated as a hexagonal nut rotationally coupled to the lead screw. As such, the turning mechanism can be operating by a torque wrench or an impact wrench. Alternatively, the turning mechanism 102 can comprise a handle. Alternatively, the turning mechanism can be hydraulically or electronically actuated.

Figure 7:
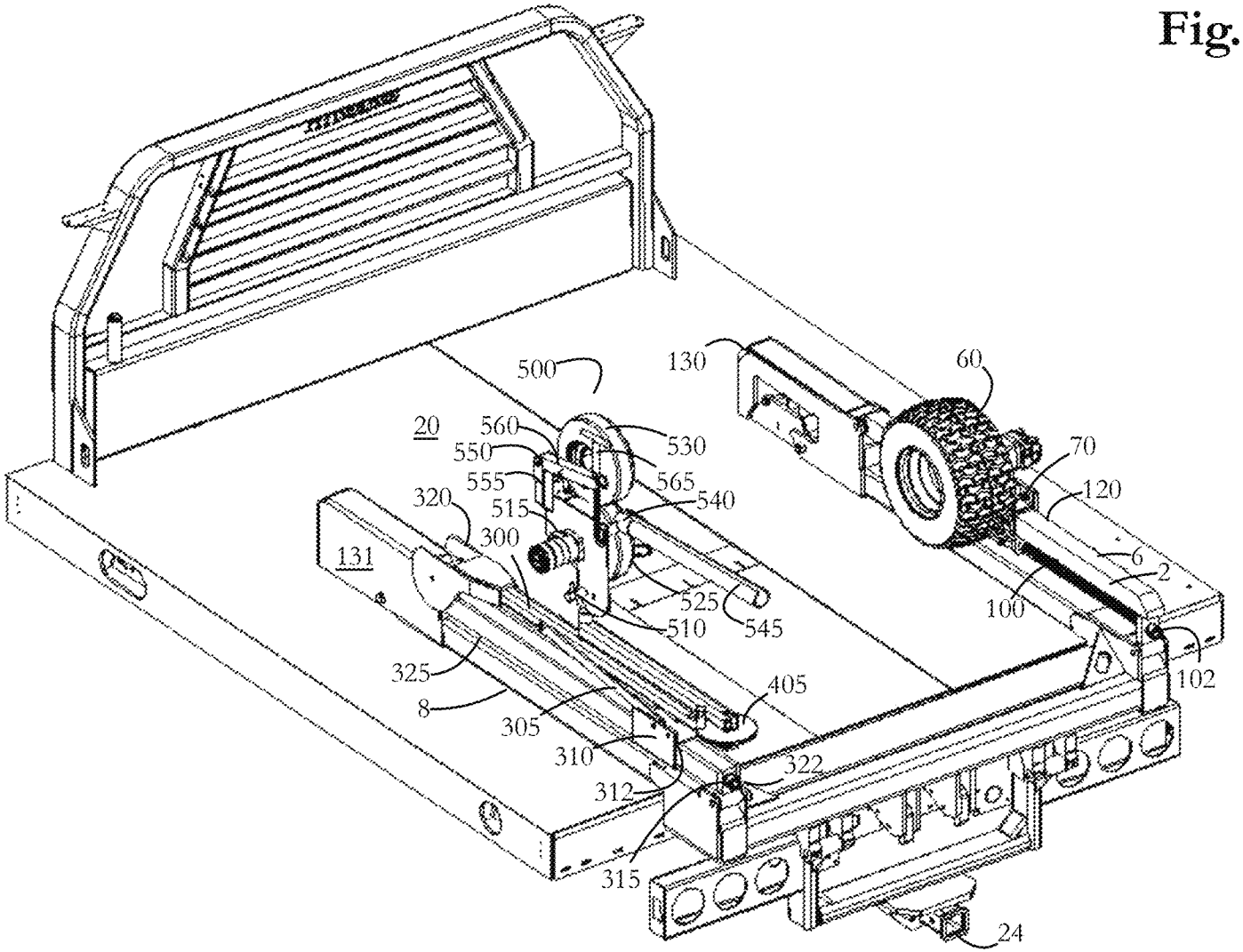
FIG. 7 depicts an in-line self-stowing configuration of the embodiment of FIG. 3.

The payout arm 400 is pivotally mounted to the free moving distal end of the primary arm 300 to enable rotational movement of the motor assembly 500 relative to an axis perpendicular to primary arm 300 and radially offset from secondary axle slot assembly 131. The payout arm 400 can be rotated to a stored position as shown in FIG. 7 where the payout arm is inline above the primary arm 300 in the self-stowed configuration. As shown in FIG. 1, the payout arm 400 can be rotated to a dispensing configuration. In the dispensing configuration, the payout arm is rotated upon the secondary pivot mount 405 to pivot free moving end 410. When the primary arm 300 is pivoted to 90° from the secondary lifting arm 8, as illustrated in FIG. 1, then the axis about which the payout arm 400 pivots is the parallel with the secondary lifting arm 8. The secondary pivot mount 405 is illustrated as a first pivot plate 406 and a second pivot plate 407. A twist lock plunger pin 408 allows the user to release the plunger pin to pivot the payout arm 400. The plunger pin is biased to a locked position. The second pivot plate 407 have a plurality of set points, where the plunger pin can secure the payout arm 400 at a predetermined angle from the primary arm 300. As illustrated, one of those set points is at a 90° angle from the primary arm 300. The payout arm 400 may be pivoted to an angle greater or less than 90°. The length of the payout arm 400 may be one-half of the distance between the first axle slot assembly 130 and the second axle slot assembly 131, such that the motor assembly 500 is centrally positioned between the first axle slot assembly 130 and the second axle slot assembly 131 when the payout arm 400 is pivoted at a 90° angle from the primary lifting arm 300. It is also contemplated that the payout arm 400 may be longitudinally extendable in order to centrally position the motor assembly behind a selected reel when multiple reels are loaded between the first axle slot assembly 130 and the second axle slot assembly 131.

The motor assembly 500 for dispensing the cable is disposed at the free moving distal end of the payout arm 400. As illustrated, the motor assembly comprises a post 505 that is received by a post sleeve 415 at the free moving distal end of the payout arm 400. A post plate 506 is attached to the post 505. A drive assembly plate 507 is mounted to the post plate. A pivot control pin 510 allows the user to selectively adjust the angle of the drive assembly plate 507 relative to the post plate 506. As illustrated in FIG. 1, this allows the drive assembly plate to rotate about an axis parallel to the payout arm 400. A motor 515 is mounted to the drive assembly plate 507. The motor 515 is operably connected to a driven wheel 525, which is also mounted to the drive assembly plate 507. The driven wheel 525 is coupled with an idler wheel 530 to provide a tractor drive for the cable.

The cable comes off of the reel through a cable guide 570. The cable guide is shown in FIG. 5 having a generally U-shape cross section. The cable guide 570 guides the cable from the reel through the cable path between the driven wheel 525 and the idler wheel 530. The cable guide 570 may be made of a low friction material such as UHMW. The U-shape allows the midpoint of the cable to be set down into the cable guide 570 without needing to feed a free terminal end of the cable therethrough.

After moving through the cable guide 570, the cable passes between the driven wheel 525 and the idler wheel 530. The driven wheel 525 and the idler wheel 530 are in intimate contact with each other and provide a tractor drive to pull the cable from the reel and propel the cable forward. In order to provide sufficient traction, the idler wheel is mounted to a clamp 550. The clamp 550 comprises a riser 555 and an idler wheel mount arm 560. A tension bar 565 is mounted to the drive assembly plate such that the tension bar 565 can be rotated up and be received by the first end of the idler wheel mount arm 560. A nut is threadably mounted on the tensioner bar 565. The distance the nut travels along the tensioner bar 565 sets the amount of traction force between the driven wheel 525 and the idler wheel 530.

The traction drive pushes the cable through the payout tube 545. The payout tube 545 is mounted to a payout collar 540 downstream of the driven wheel 525 and the idler wheel 530. The payout tube 545 directs the path of the cable as the cable is ejected from the motor assembly 500. Pivoting the drive assembly plate 507 affects the orientation of the payout tube 545. It may be advantageous for efficient figure eighting to pivot the payout tube upward, at an angle above horizontal. Since the motor assembly 500 is mounted to the secondary lift arm 8, the motor assembly 500 maintains its proximity to the reel in any lift position or pivot position.

The motor 515 can be a hydraulic motor. A hydraulic motor can utilize the vehicle's hydraulics. A separate hydraulic circuit can be provided to control the motor 515. The hydraulic hoses can be secured to the rail 120 or the lifting arms 2, 8. The motor 515 is operationally coupled to the rewind/traction driven wheel 60. Alternatively, the motor 515 uses another power source, such as electric or pneumatic power.

Figure 8:
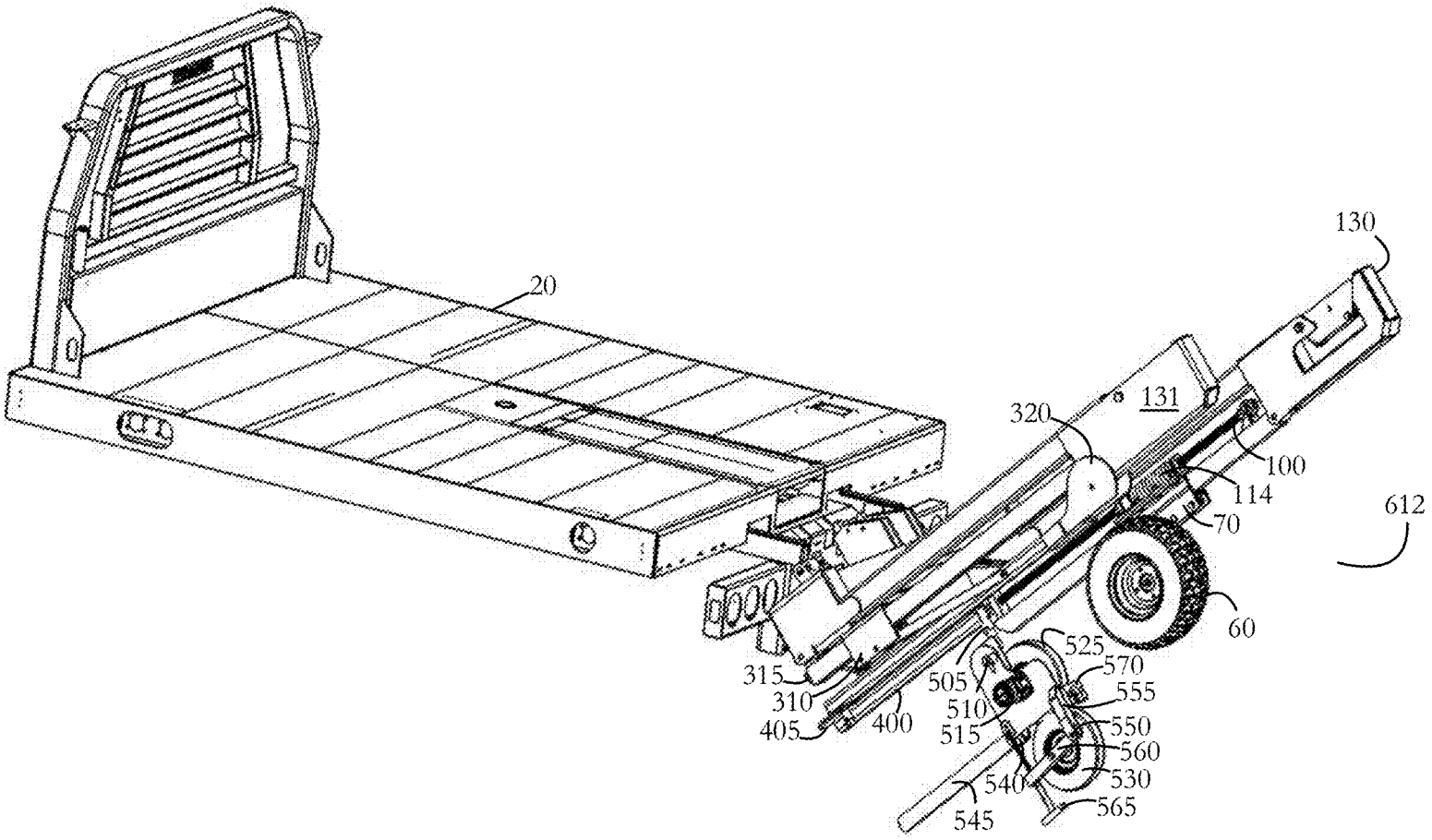
FIG. 8 depicts the lifting arms in an extended position reaching behind the vehicle demonstrating the movement of the cable dispensing mechanism with the lifting arms.
Figure 9:
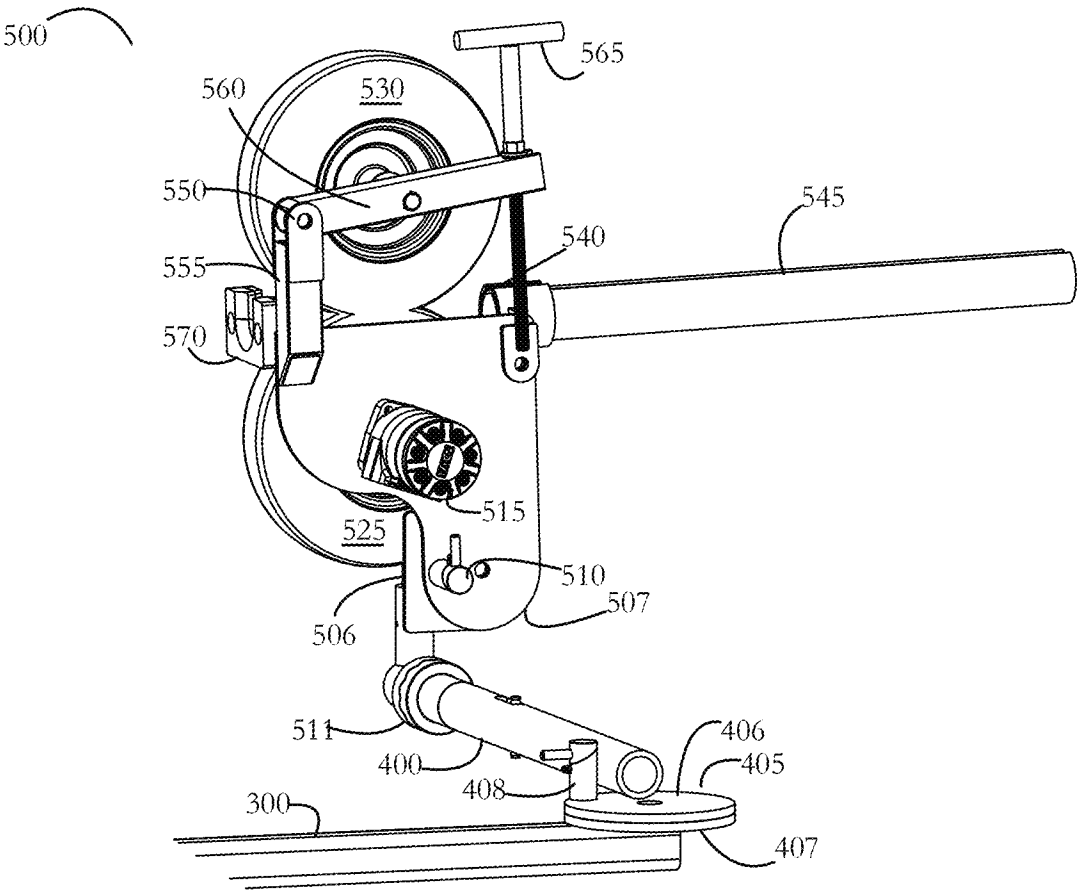
FIG. 9 depicts an enlarged view of a cable dispensing mechanism mounted to a payout arm having an inline adjustable swivel coupling to enable pivoting of the cable dispensing mechanism similar to the movement illustrated in FIG. 2.
Figure 10:
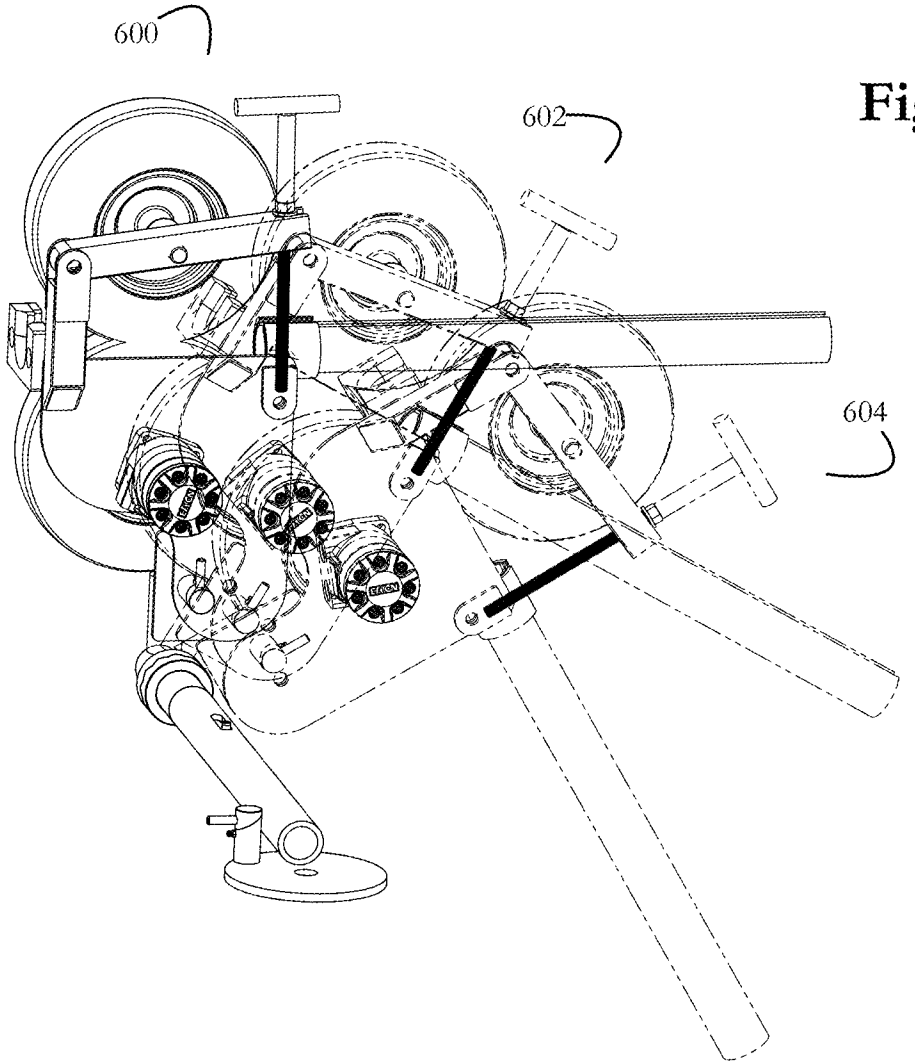
FIG. 10 depicts movement of the cable dispensing mechanism due to the inline adjustable swivel coupling on the payout arm.
Figure 11:
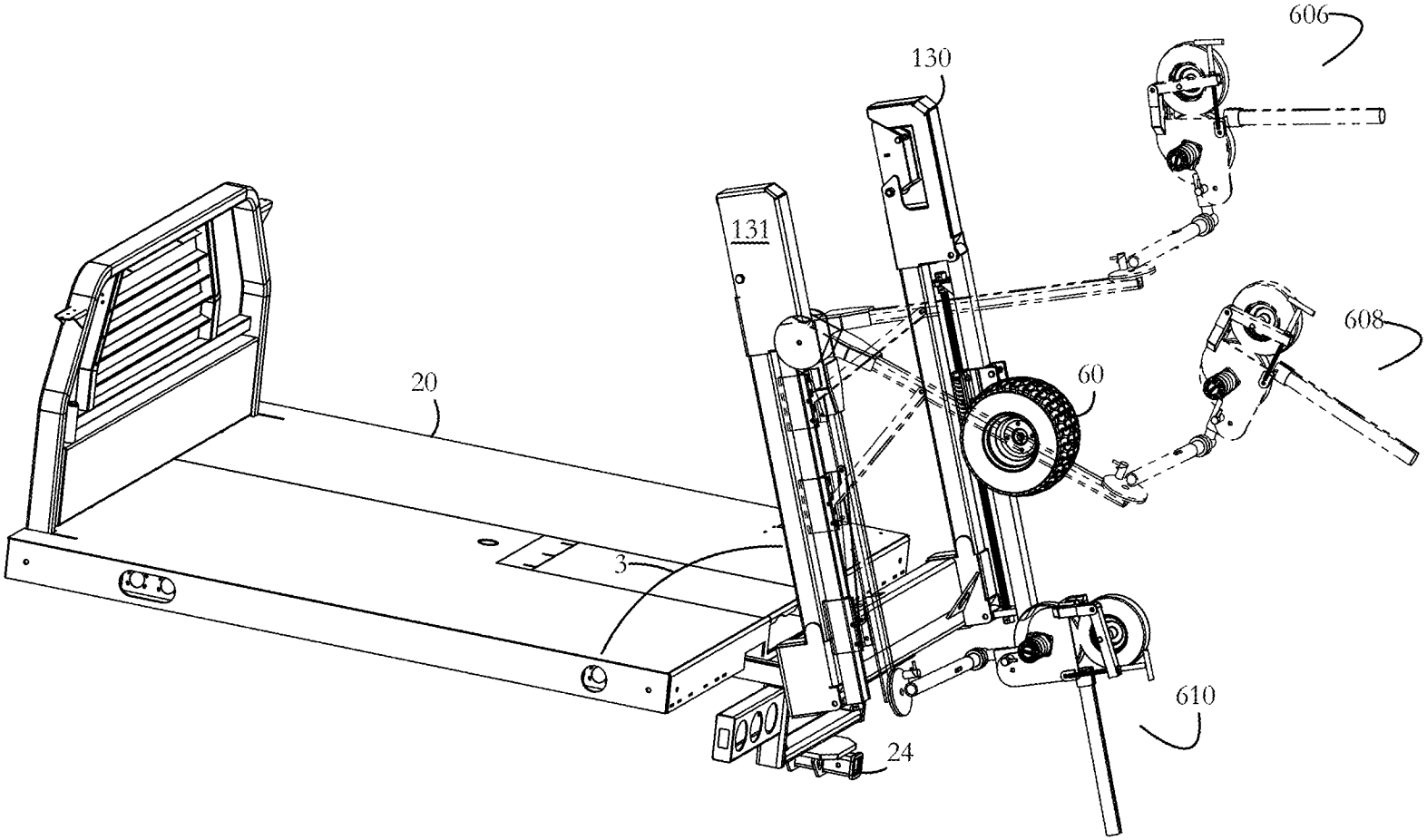
FIG. 11 depicts movement of the primary arm between the retracted, partially raised, and raised configuration of the embodiment of FIG. 9.
Figure 12:
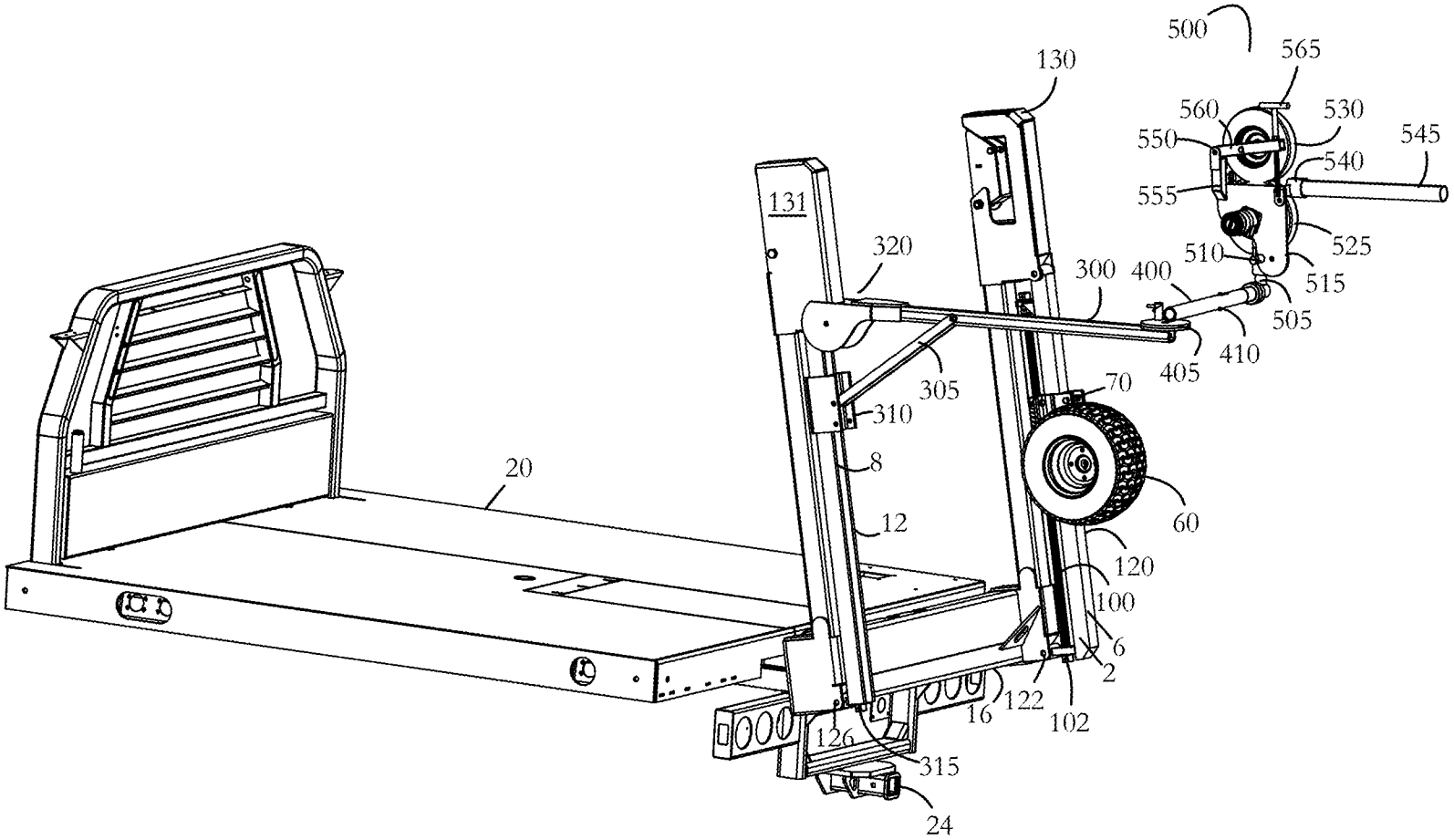
FIG. 12 depicts the embodiment of FIG. 9 in a ready to dispense configuration.
Figure 13:
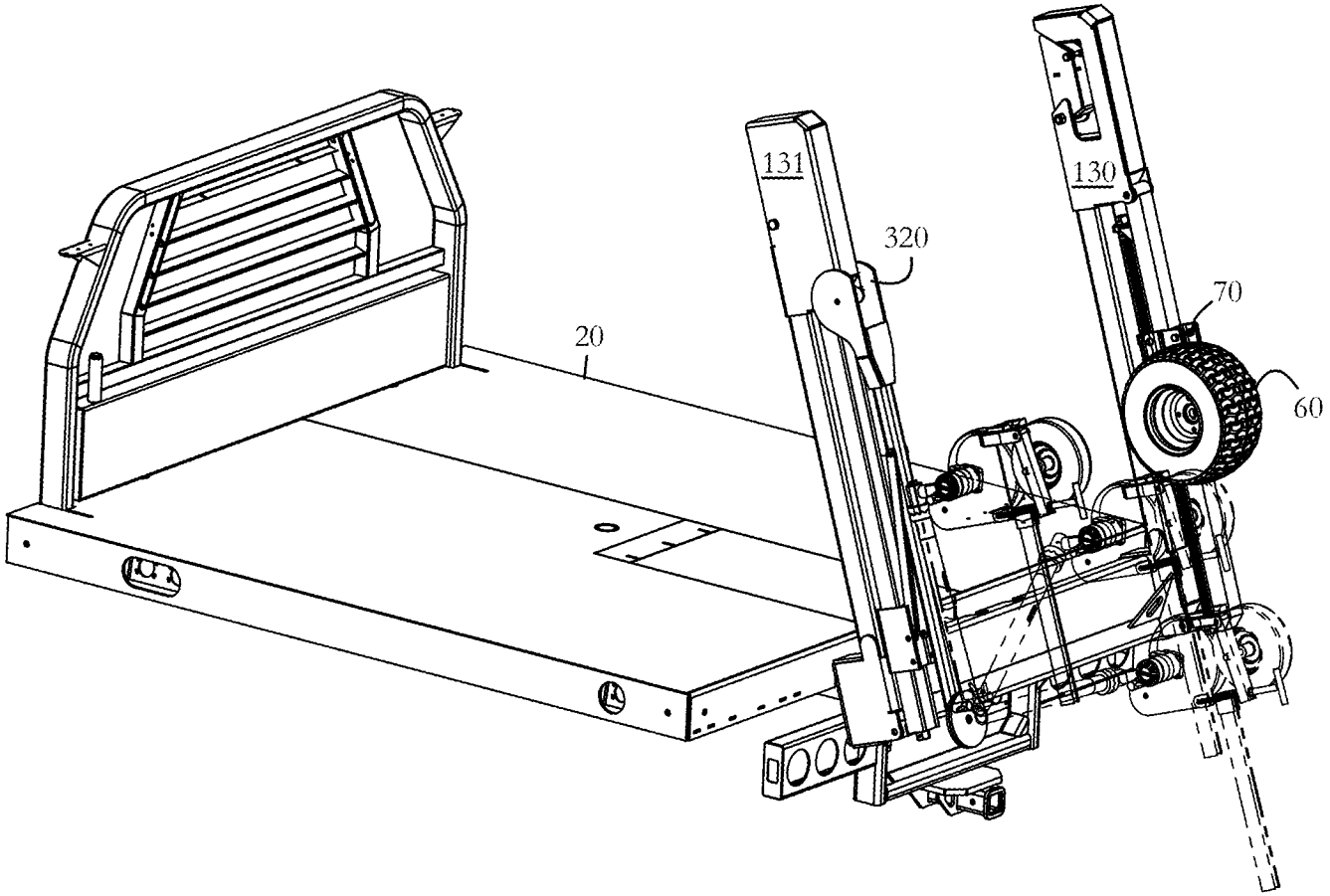
FIG. 13 depicts movement of the payout arm between the retracted, partially deployed, and deployed configuration of the embodiment of FIG. 9.
Figure 14:
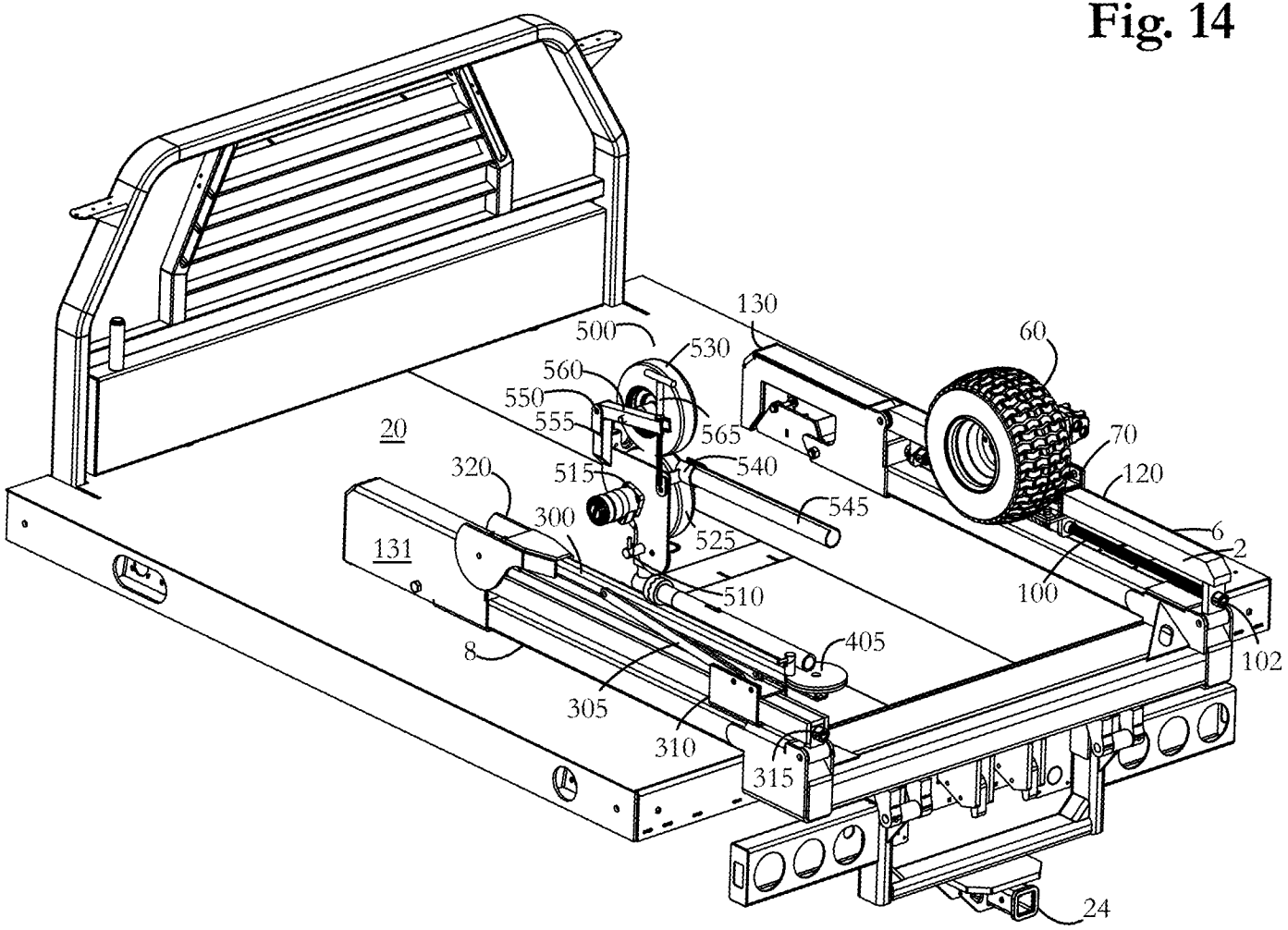
FIG. 14 depicts the cable dispensing mechanism of FIG. 9 in the self-stowed orientation.
Figure 15:
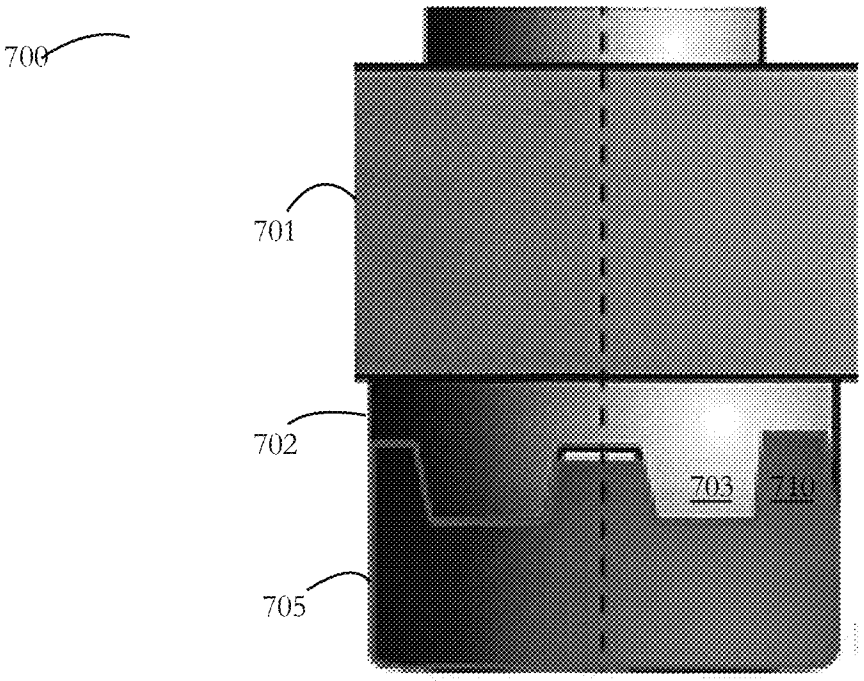
FIG. 15 depicts an enlarged view of an inline adjustable swivel coupling.

As illustrated in FIG. 7, an inline jaw coupling 511 may be incorporated into the payout arm 400 to facilitate pivoting of the motor assembly 500 about the longitudinal axis of the payout arm 400, as shown in FIG. 8. The lifting arms 2, 8 are shown in an extended position 612 behind the truck bed 20. The motor assembly 500 may rotate between an upright position 600, a partially lower pivot position 602, and a lowered pivot position 604. A second inline jaw coupling may be inserted at the post 505 to enable the motor assembly to pivot about the longitudinal axis of the post 505. The second inline jaw coupling enables the motor assembly 500 to pivot inline with the payout arm 400, as illustrated in FIGS. 5 and 14. An enlarged view of an inline jaw coupling 700 is shown in FIG. 15. The inline jaw coupling 700 has a fastener 701, which maintains the first jaw portion 702 engaged with a second jaw portion 705. The first jaw portion 702 has a plurality of teeth 703 having an outwardly converging trapezoidal shape. The second jaw portion 705 has complementary set of trapezoidal teeth 710. In an engaged configuration, the inline jaw coupling 700 prevents rotation. By disengaging the fastener 701, the inward force upon the first jaw portion 702 toward the second jaw portion 705 is released, allowing the first jaw portion 702 to rotate relative to the second jaw portion 705. Each of the teeth 703, 710 provide a plurality of discrete rotation positions through which the inline jaw coupling 700 can be secured.

In order to securely hold the reel 3, the reel axle is received into an axle slot assembly 130, as shown in FIG. 1. A first axle slot assembly 130 is located at the distal end of the first lifting arm 2 and a second axle slot assembly 131 is at the distal end of the second lifting arm 8—the distal end of the arm being the end distal from point where the arm connects to the bed surface 20. The depth of the slot may correspond approximately to the height of the reel axle. In the extended arm position, a slot opening in each of the axle slot assemblies faces upwards. In order to load a reel 3, the user extends the lifting arms 2,8 to the extended position and opens the locking cover assembly. The truck is backed into position until the slot opening is below the reel axle. The user raises the arms 2,8 such that the reel axle is received into the axle slot assemblies 130, 131 through the slot opening. Once the arms 2, 8 lift the reel 3 off the ground and above an angle perpendicular to the ground, the reel slides or rolls under force of gravity into a home position under the fixed mounting assembly. The user pivots the locking cover assembly to the closed or locked position in which the locking cover assembly covers the slot. The locking mechanism engages with the stop mechanism to secure the reel axle in the home position.

Figure 16:
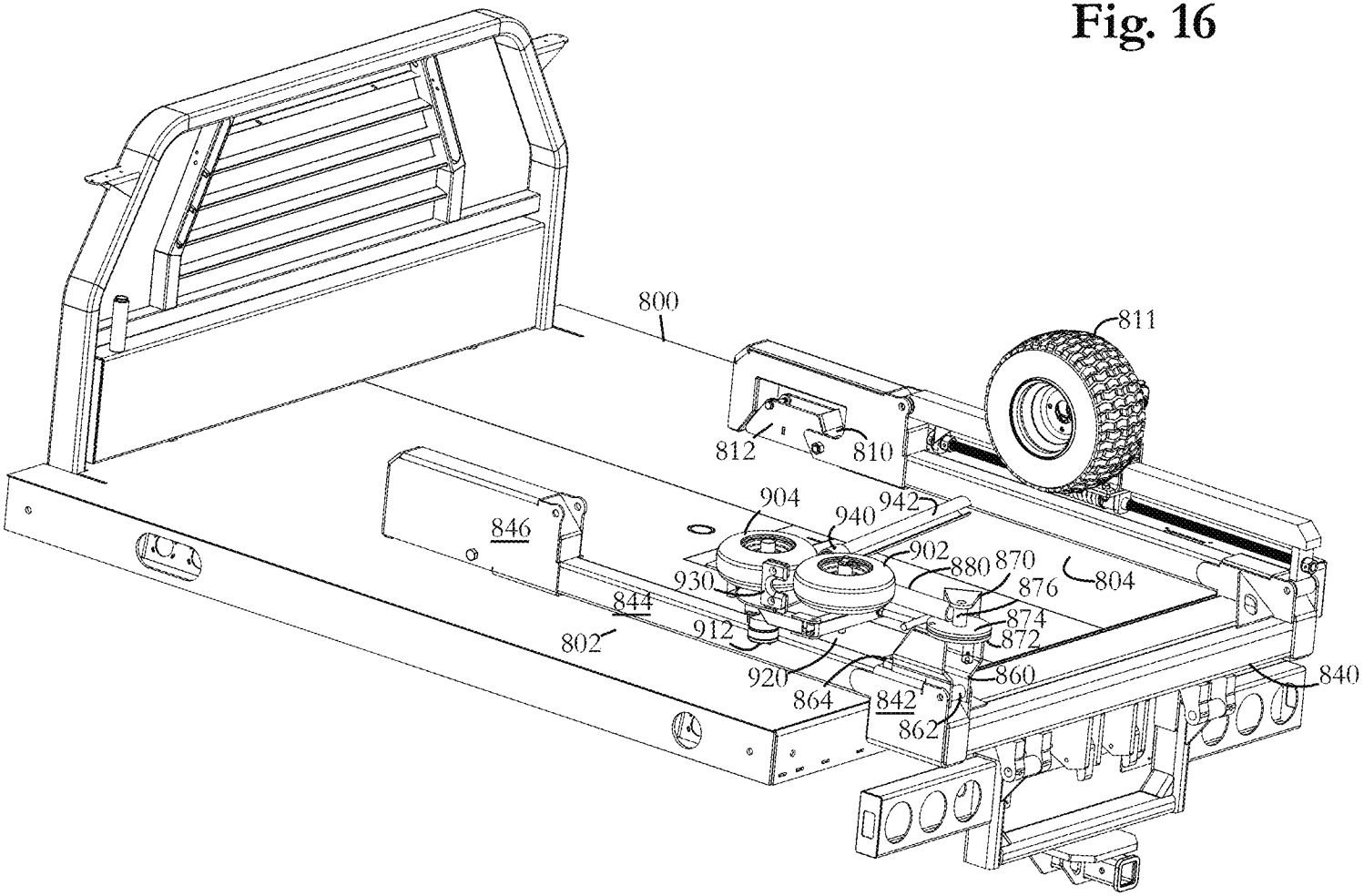
FIG. 16 depicts a rear side perspective of another embodiment of a cable dispensing mechanism with the adjustable frame in a self-stowed configuration inline with the lifting arm.

In another embodiment shown in FIGS. 16-26, in order to dispense cable 993 from the reel 990, the adjustable frame positions the motor assembly 920 on the dispensing side of the reel 990. As illustrated in FIG. 16, the reel lift apparatus has a first lifting arm 802 and a second lifting arm 804, which are mounted in a U-shaped orientation to cross member 840. The reel 990 is mounted to the free moving ends of the lifting arms 802, 804 with the reel axle. The reel axle is not shown, but is centrally disposed within the reel 990 and extends beyond rim 991 and rim 992. The reel axle is received within the first axle slot assembly 846 and the second axle slot assembly 809. The reel axle is received into the respective axle slot assembly and locked into the home position 810 when the locking cover assembly 812 is in the closed position. The reel 990 may be raised above the vehicle bed 800 with the lifting arms 2, 8. The lifting arms 802, 804 are configured to move the reel 990 through a plurality of lift positions. A rewind/traction driven wheel 811 is shown on a rail parallel to lifting arm 804.

Figure 25:
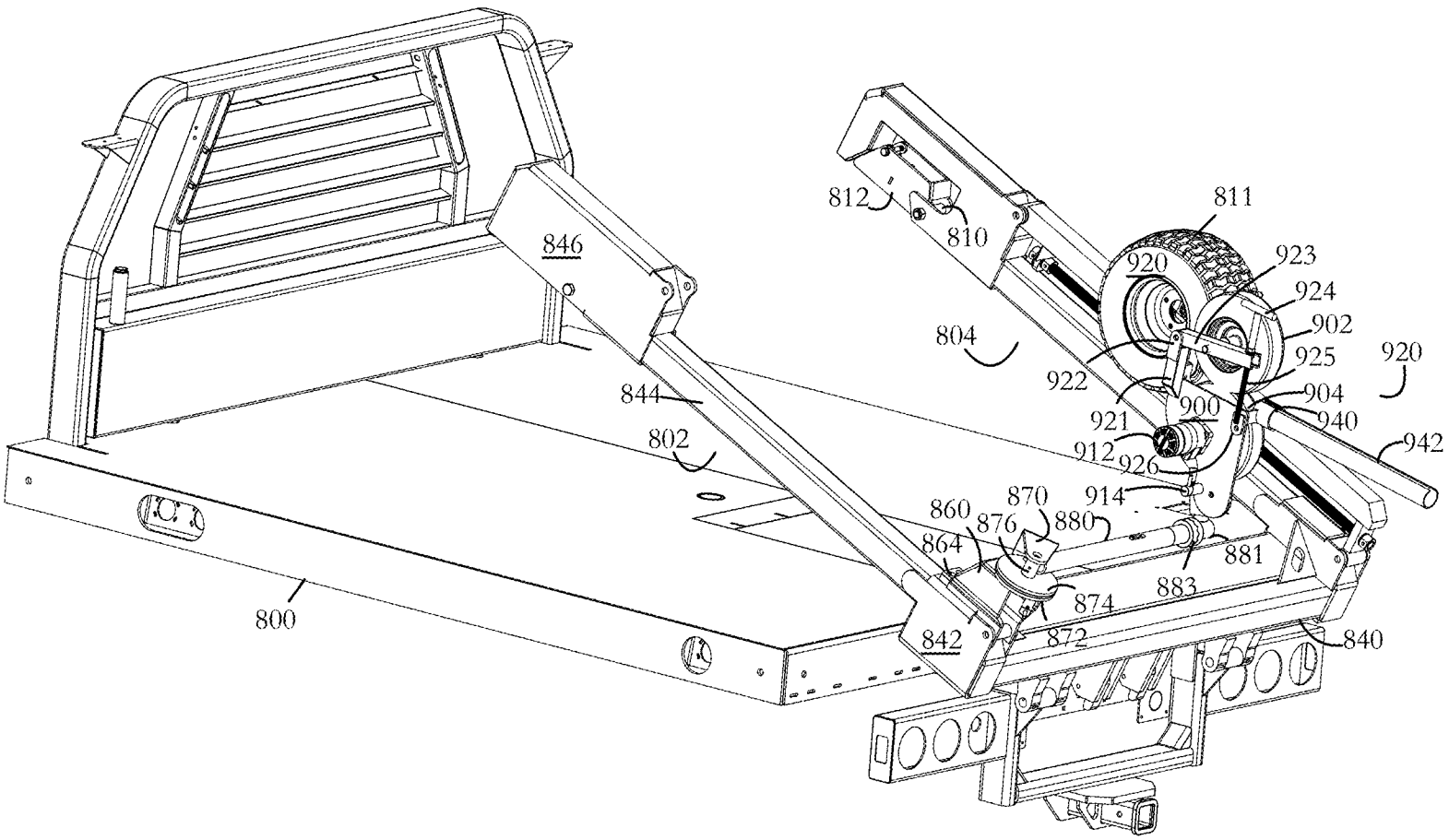
FIG. 25 depicts a rear side perspective of the embodiment of FIG. 16, with the payout arm perpendicular to the lifting arm and the motor assembly rotated into a dispensing position.
Figure 26:
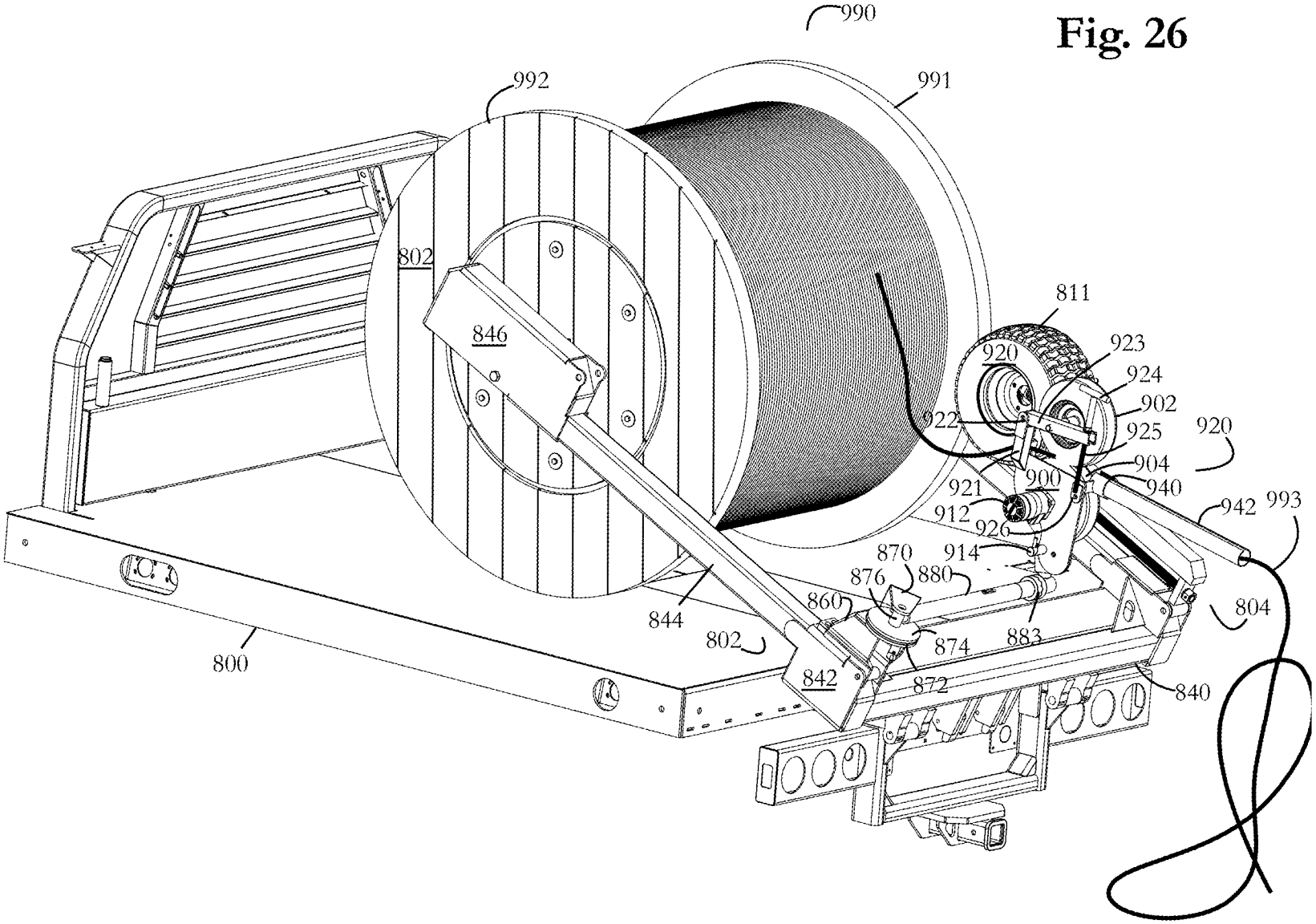
FIG. 26 depicts a rear side perspective of the embodiment of FIG. 16, with a reel axle mounted between the lifting arms and the payout arm rotated perpendicular to the lifting arm such that the payout arm is parallel with the reel axle, the motor assembly rotated into a dispensing position to the rear of the vehicle and the reel.

To dispense the cable 993 (or other reelable material), the adjustable frame positions the motor assembly 920 into a deployed position. As shown in FIGS. 25-26, the payout arm 880 is pivoted to a horizontal position perpendicular to the lifting arm 802. The lifting arm 802 has a proximal end 842, a central portion 844, and a first axle slot assembly 846. The payout arm 880 is configured to rotate about an axis perpendicular to the lifting arm 802. The rotation assembly comprises a first rotating disk 872 mounted to a second rotating disk 874. The first rotating disk 872 rotates about shaft 876. The rotation assembly is mounted to a mounting member 864 that raises the rotation assembly above the proximal end 842 of lifting arm 802. The mounting member 864 is secured to the proximal end 842 of the lifting arm 802 through a securing member 862, which allows the mounting member 864 to be secured to the lifting arm 802 with a bolt or other fastener.

Figure 17:
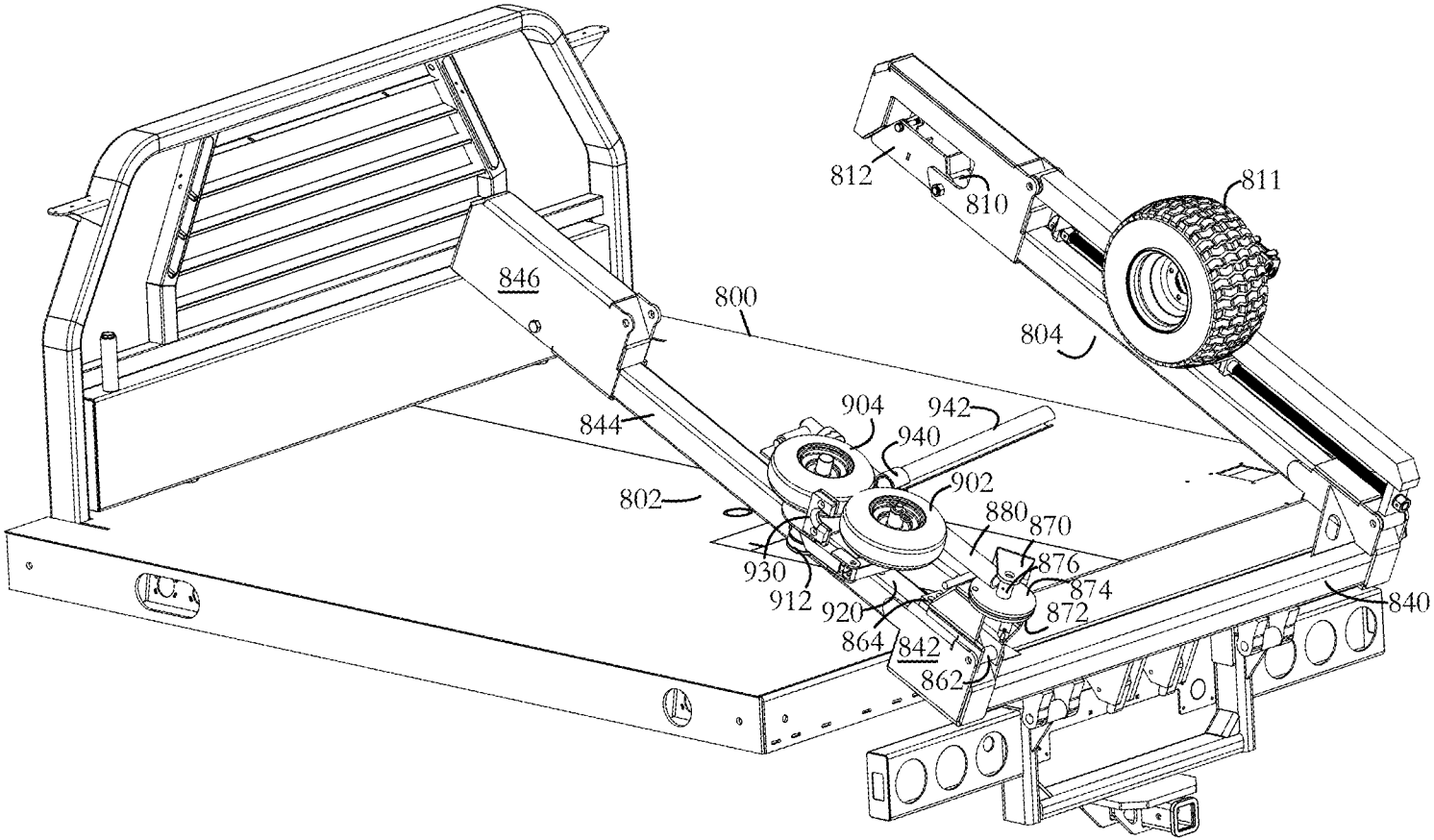
FIG. 17 depicts a rear side perspective of the embodiment of FIG. 16, with the lifting arms raised above the vehicle bed with the adjustable frame in a self-stowed configuration inline with the lifting arm.
Figure 18:
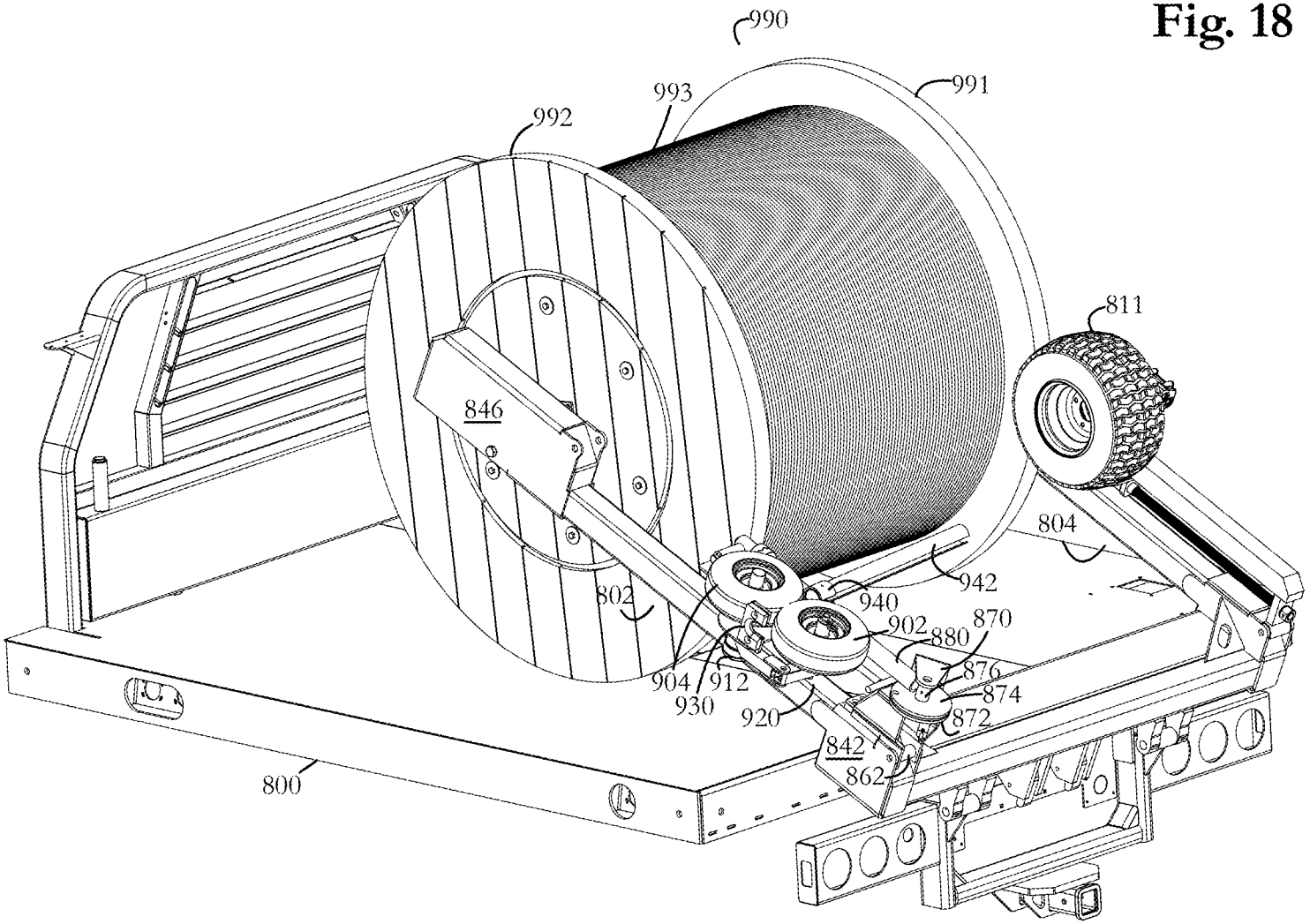
FIG. 18 depicts a rear side perspective of the embodiment of FIG. 16, with a reel mounted between the lifting arms, with the reel in the stored configuration resting on the vehicle bed.
Figure 19:
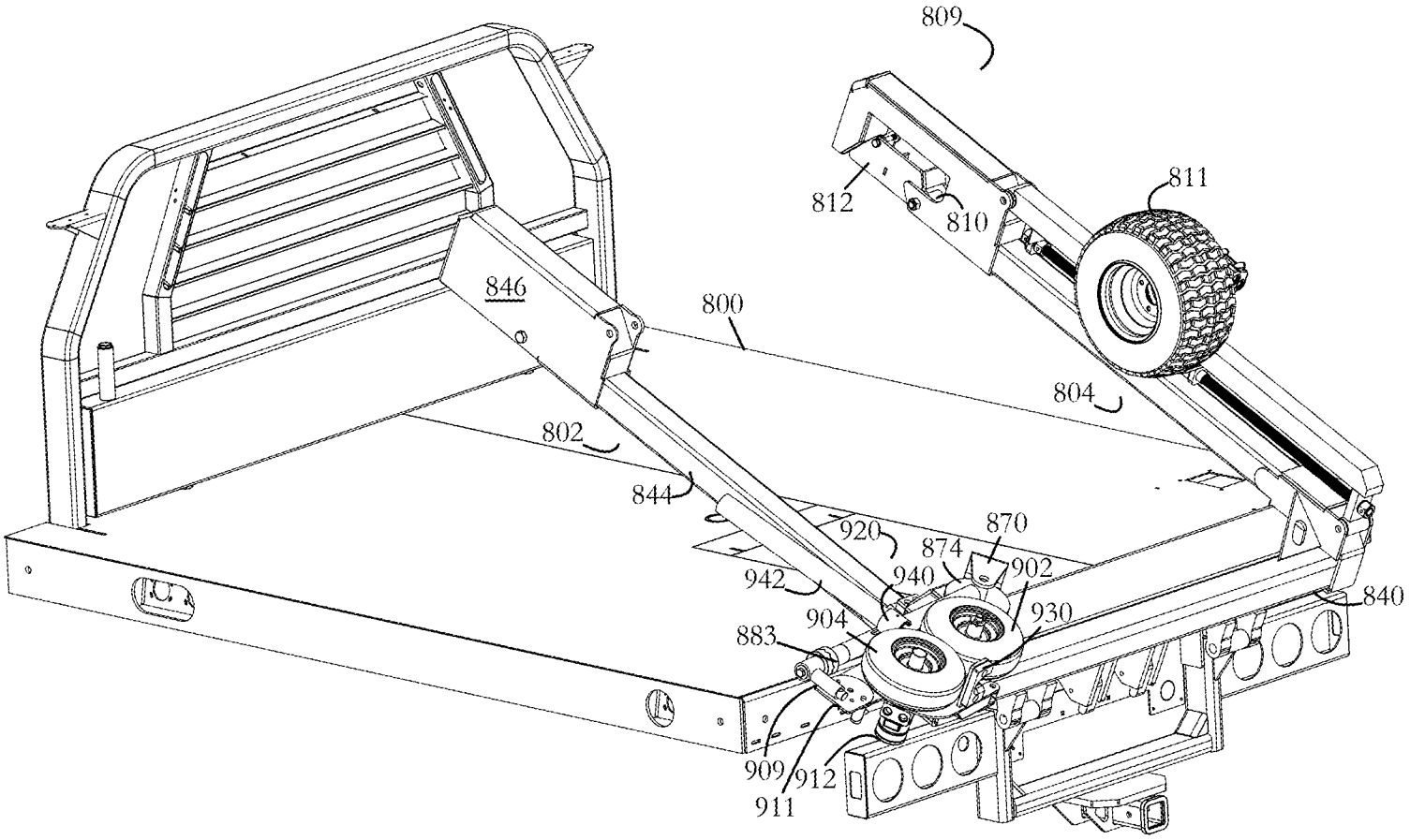
FIG. 19 depicts a rear side perspective of the embodiment of FIG. 16, with the payout arm partially rotated about a first axis that is perpendicular to the lifting arm.
Figure 20:
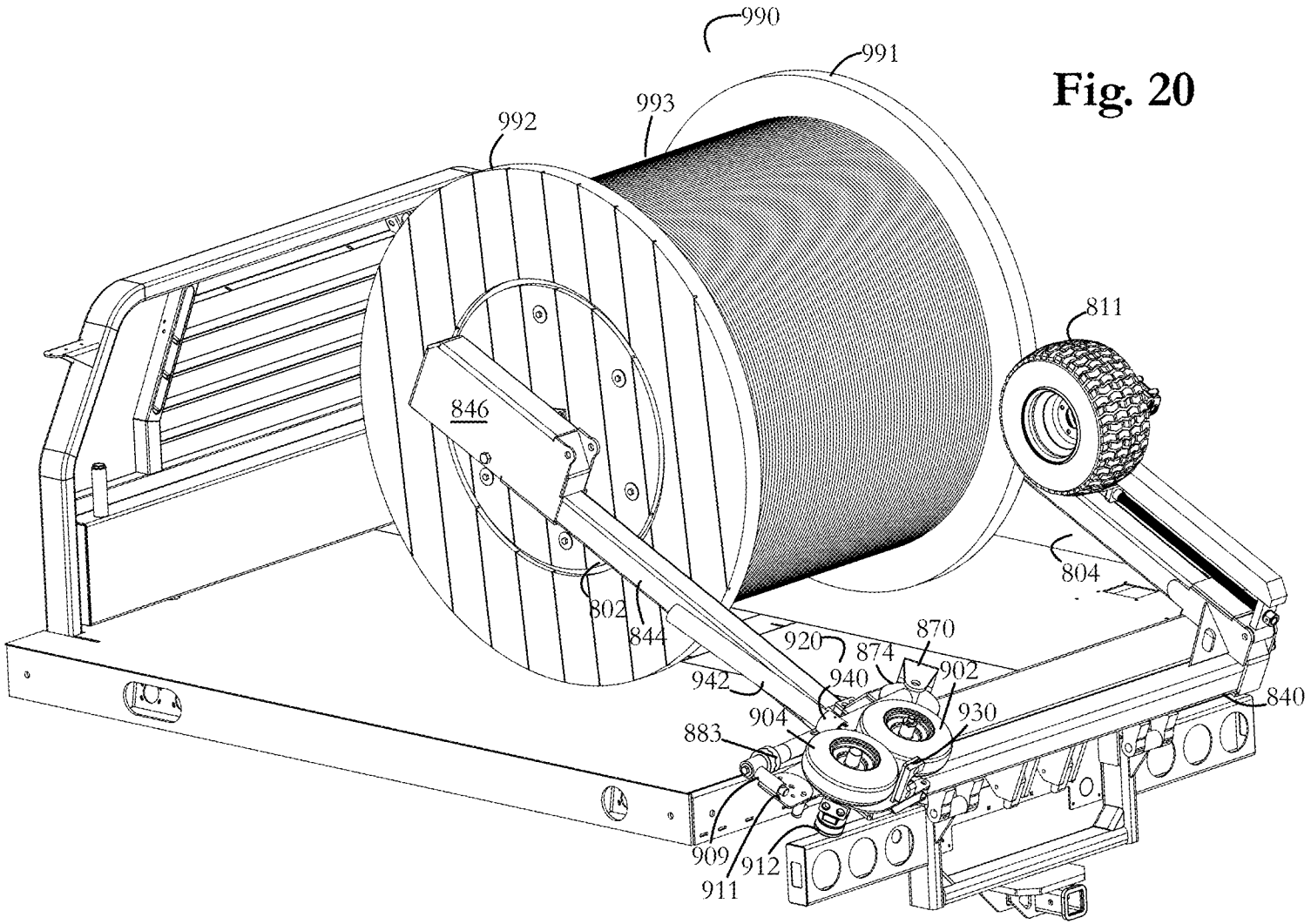
FIG. 20 depicts a rear side perspective of the embodiment of FIG. 16, with a reel mounted between the lifting arms, with the reel in the stored configuration resting on the vehicle bed, and the payout arm partially rotated about a first axis that is perpendicular to the lifting arm.
Figure 21:
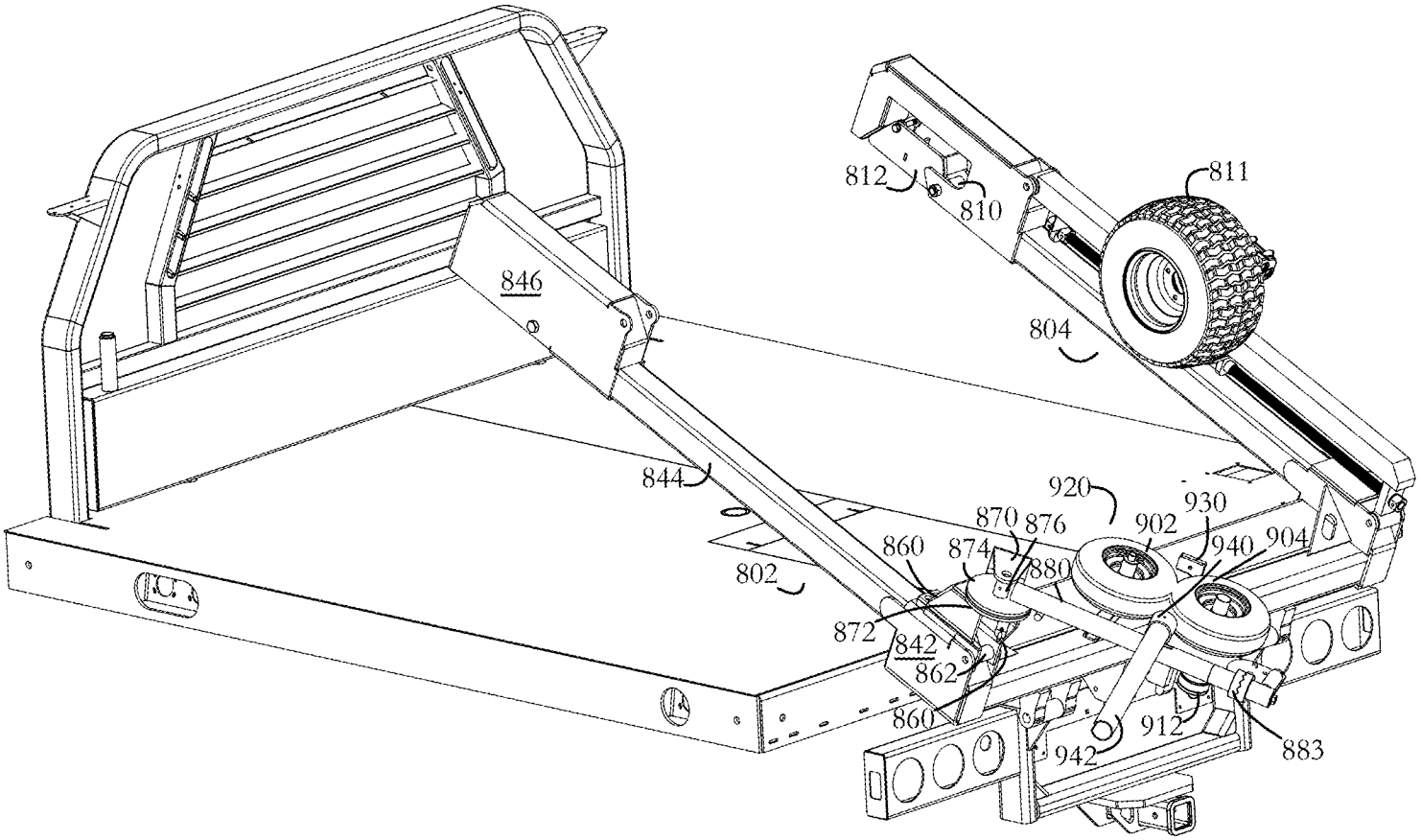
FIG. 21 depicts a rear side perspective of the embodiment of FIG. 16, with the payout arm partially rotated about a first axis that is perpendicular to the lifting arm.
Figure 22:
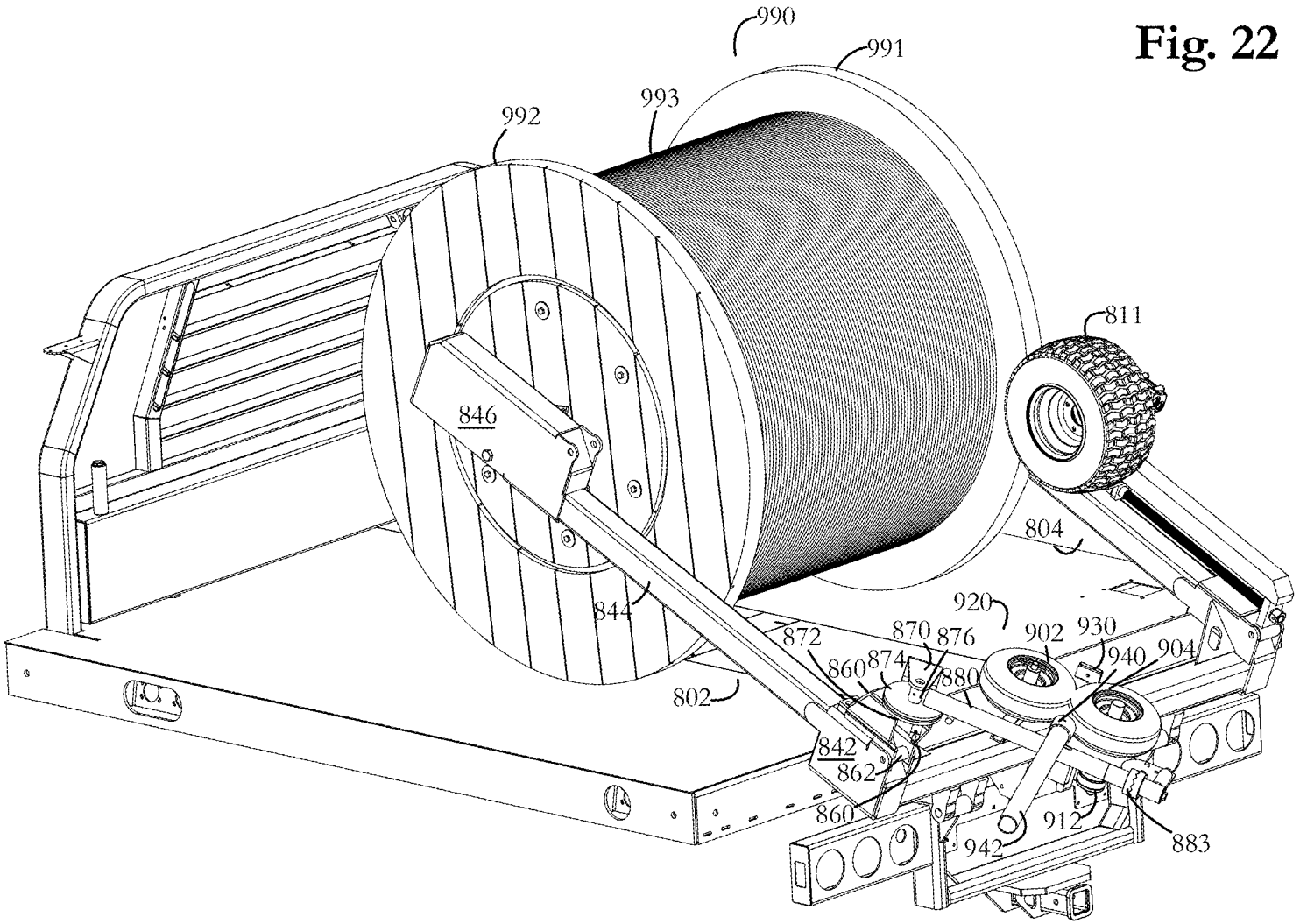
FIG. 22 depicts a rear side perspective of the embodiment of FIG. 16, with a reel mounted between the lifting arms, with the reel in the stored configuration resting on the vehicle bed, and the payout arm partially rotated about a first axis that is perpendicular to the lifting arm.
Figure 23:
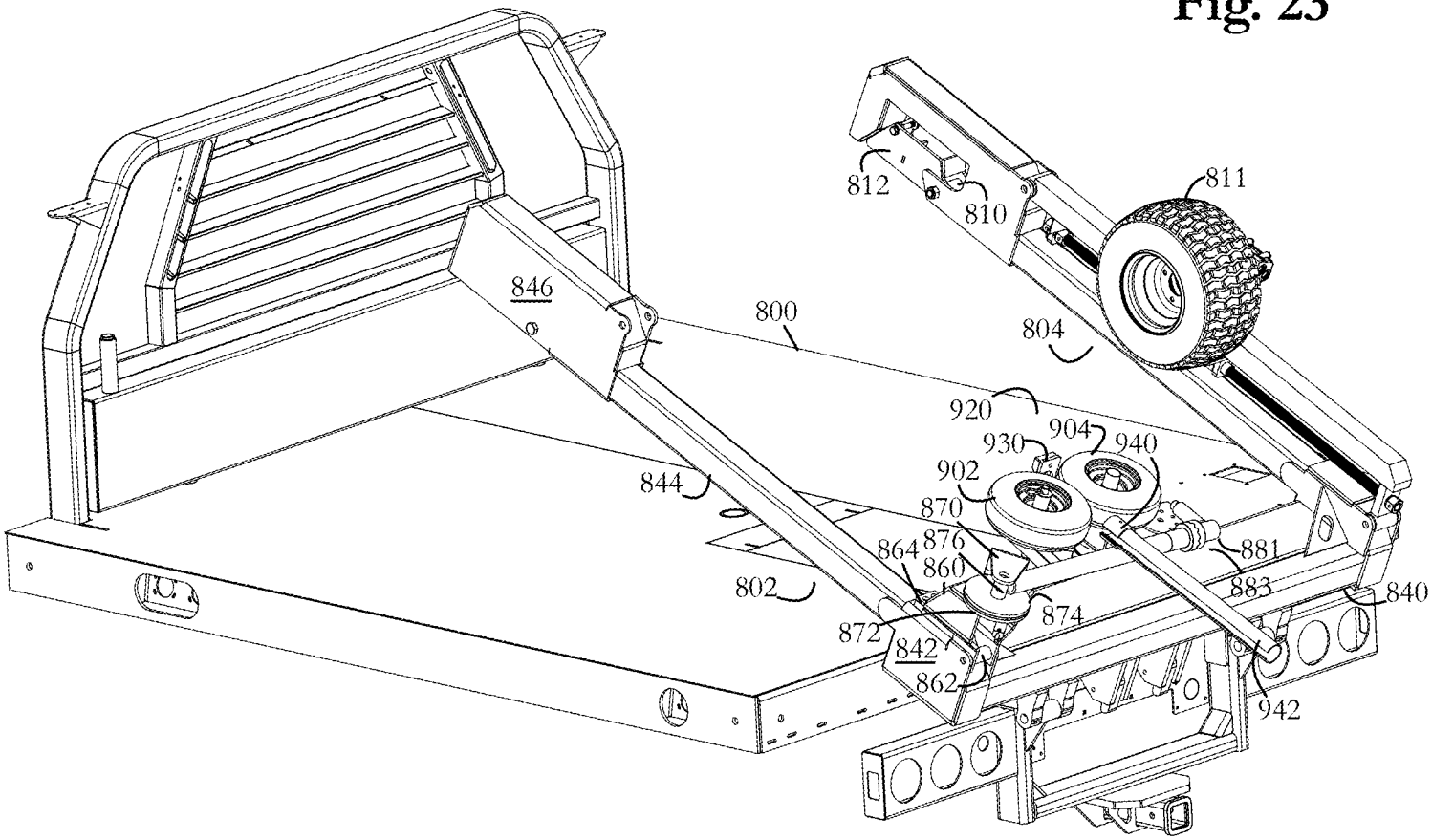
FIG. 23 depicts a rear side perspective of the embodiment of FIG. 16, with the payout arm partially rotated about a first axis that is perpendicular to the lifting arm such that the payout arm is perpendicular to the lifting arm.
Figure 24:
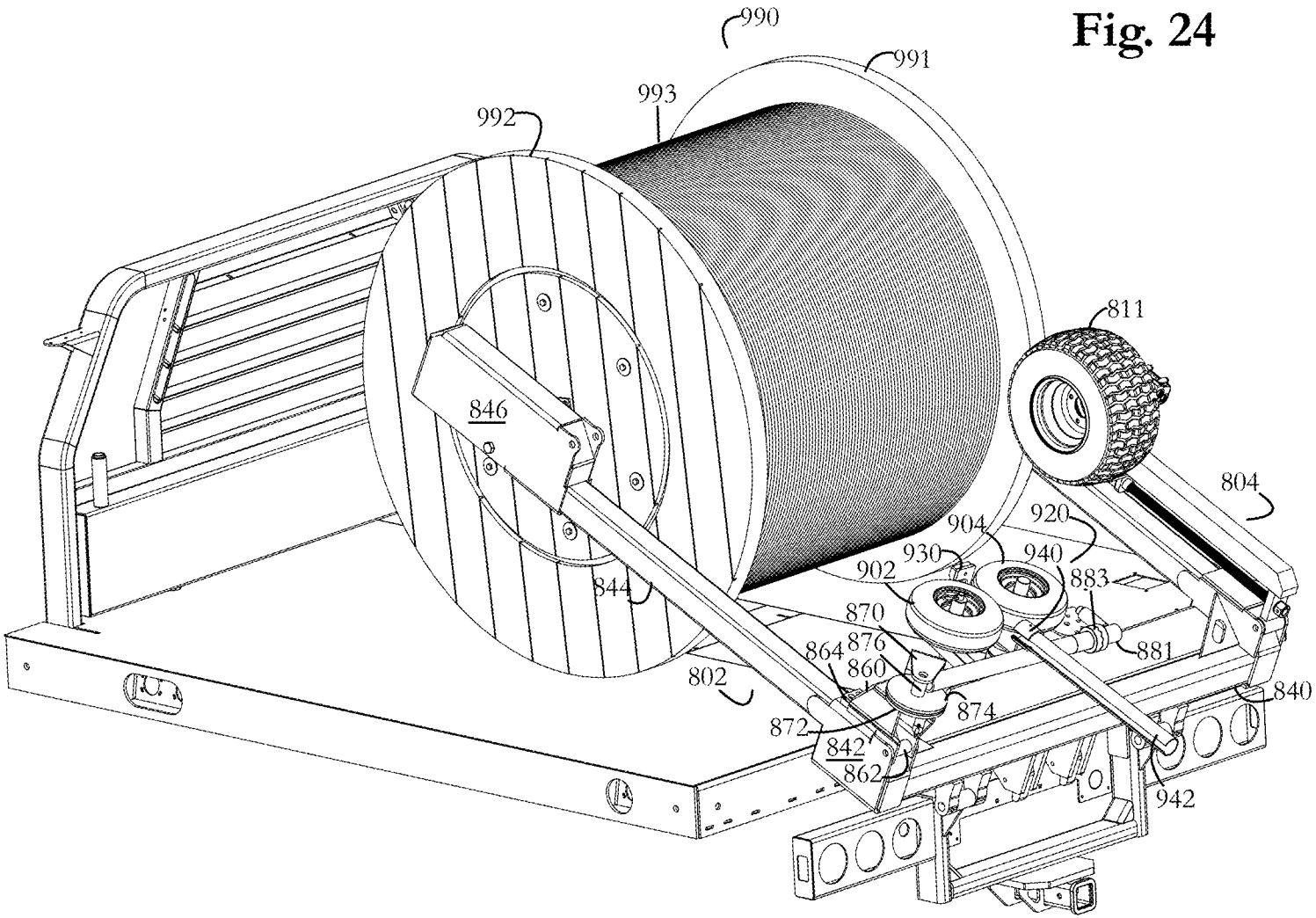
FIG. 24 depicts a rear side perspective of the embodiment of FIG. 16, with a reel axle mounted between the lifting arms, with the reel in the stored configuration resting on the vehicle bed, and the payout arm partially rotated about a first axis that is perpendicular to the lifting arm such that the payout arm is parallel with the reel axle.

The payout arm 880 is restricted from rotating in a full circle by stop member 870. Stop member 870 prevents the payout arm 880 from rotating into reel 990 and may provide structure to the rotation assembly. A twist lock plunger pin 860, or other locking mechanism, allows the user to release a plunger pin to pivot the payout arm 400 about the rotation assembly. The plunger pin is biased to a locked position through one or both of the first rotating disk 872 and the second rotating disk 874. One of the first rotating disk 872 or the second rotating disk 874 has a plurality of set points, where the plunger pin can secure the payout arm 880 at a predetermined angle from the lifting arm 802. As illustrate, the payout arm may be secured in an inline stored rotation as shown in FIG. 16, FIG. 17, and FIG. 18. The payout arm may be rotated through a preliminary deployed position as shown in FIGS. 19-22. The payout arm 880 may be locked in any of these points, or any intermediate points therebetween, by providing a set point in one of the first rotating disk 872 or the second rotating disk 874. The payout arm 880 rotates through to a set point where the longitudinal axis of the payout arm 880 is at a 90° angle from the lifting arm 802 and is parallel with the reel axle. The payout arm 880 may be pivoted to an angle greater or less than 90°, as limited by the stop member 870. The length of the payout arm 880 may be one-half of the distance between the first axle slot assembly 846 and the second axle slot assembly 809, such that the motor assembly 920 is centrally positioned between the first axle slot assembly 846 and the second axle slot assembly 809 when the payout arm 880 is pivoted at a 90° angle from the lifting arm 802. It is also contemplated that the payout arm 880 may be longitudinally extendable in order to centrally position the motor assembly behind a selected reel when multiple reels are loaded between the first axle slot assembly 846 and the second axle slot assembly 809. The length of the payout arm 880 that is non-extendable may be limited by the rim diameter of the reel 990.

As shown in FIGS. 23, 24, 25, and 26, the motor assembly 920 is rotationally mounted to the free moving distal end of the payout arm 880. The payout arm 880 has an inline rotational coupling 883 to rotate the motor assembly 920 about the longitudinal axis of the payout arm 880.

Figure 28:
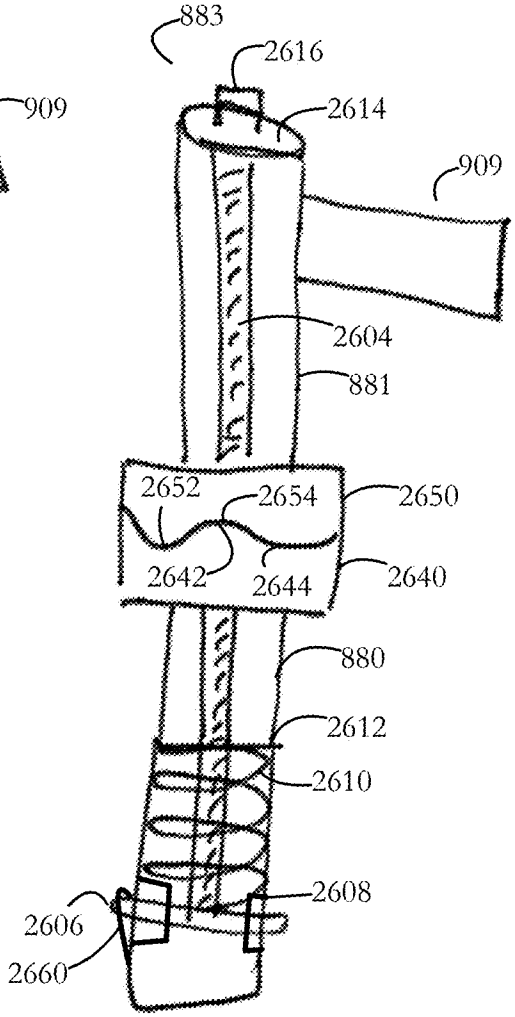
FIG. 28 depicts an inline jaw coupling that may be incorporated into the payout arm in a locked configuration.
Figure 27:
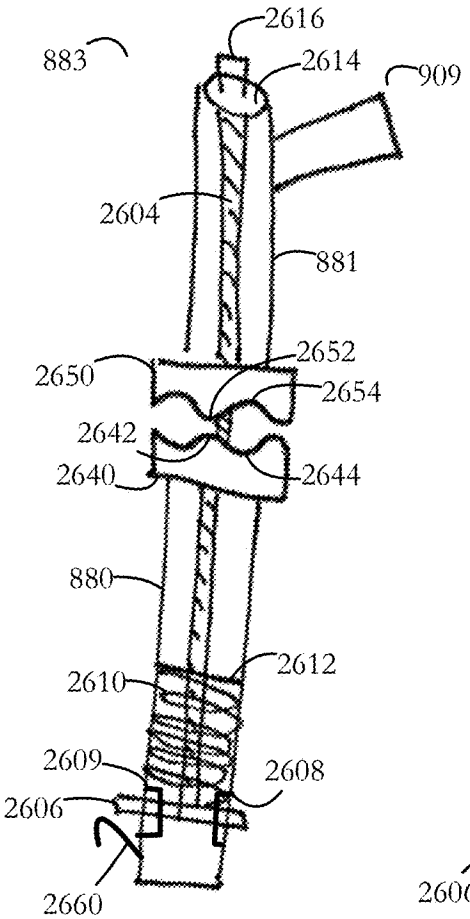
FIG. 27 depicts an inline jaw coupling that may be incorporated into the payout arm in an unlocked configuration.

An inline rotational coupling 883 is shown in detail in FIGS. 27-28. The rotational coupling 883 comprises a shaft 2604 that extends from an external secured portion 2616 through a top cap 2614 of payout tube terminal end portion 881 (also referred to as a second payout arm portion) and into the payout arm 880 (where the end portion proximal to the primary arm is also referred to as a first payout arm portion). The shaft 2604 is coupled with a cross member 2606 that extends perpendicularly to the shaft 2604 to form a T-shape. The ends of the cross member 2606 extend out of the payout arm 880 through a first aperture 2608 and a second aperture 2609. The first aperture 2608 and the second aperture 2609 allow the cross member 2606 to slide parallel to longitudinal axis of the payout arm 880. A spring 2610, or other biasing member, is disposed about the shaft 2604 between the cross member 2606 and a blocking element 2612 disposed internal to the payout arm 880. In one embodiment, the blocking element 2612 is a tube with a small internal opening diameter, such that the spring 2610 is blocked from extending into the smaller internal opening. Between the payout tube terminal end portion 881 and the payout arm 880 are a first jaw portion 2640 engaged with a second jaw portion 2650. The first jaw portion 2640 has a plurality of teeth 2642 and valley portions 2644 having a generally sinusoidal pattern. In another embodiment, the teeth 2642 have an outwardly converging trapezoidal shape. The second jaw portion 2650 has complementary set of teeth 2652 and valley portions 2654. In an engaged configuration, the inline rotational coupling 883 prevents rotation. A latch mechanism 2660 prevents the cross member 2606 from moving along the longitudinal axis of the payout arm 880, which maintains the teeth 2642 of the first jaw portion 2640 engaged with the valley portion 2654 of the second jaw portion 2650. By disengaging the latch mechanism 2660, the cross member 2606 is allowed to move in the longitudinal axis of the payout arm 880. The user is able to rotate the payout tube terminal end portion 881 relative to the payout arm 880, which causes the jaw to separate, as shown in FIG. 27. The biasing force of the spring 2610 brings the first jaw portion 2640 and second jaw portion 2650 back together, as shown in FIG. 28. Each of the teeth 2642, 2652 and valley portions 2644, 2654 provide a discrete rotation position through which the inline rotational coupling 883 can be secured.

Once the payout arm 880 is rotated via the inline rotational coupling 883, the motor assembly 920 is pivoted into an upright position. A pivot control pin 914 allows the user to selectively adjust the angle of the drive assembly plate 900 relative to the post plate 911 and post 909. As illustrated in FIG. 26, this allows the drive assembly plate 900 to rotate about an axis parallel to the payout arm 880. A motor 912 is mounted to the drive assembly plate 900. The motor 912 is operably connected to a driven wheel 904, which is also mounted to the drive assembly plate 900. The driven wheel 904 is coupled with an idler wheel 902 to provide a tractor drive for the cable. The cable (or other reelable material) exits the tractor drive through payout tube 942. The payout tube 942 is mounted to a payout collar 940 downstream of the driven wheel 904 and the idler wheel 902. The payout tube 942 directs the path of the cable as the cable is ejected from the tractor drive. Pivoting the drive assembly plate 900 affects the orientation of the payout tube 942.

The cable comes off of the reel through a cable guide 930, which is upstream of the tractor drive assembly. The cable guide is shown in FIGS. 16, 17, 19, 20, 21, 22, 23, and 24 as having a generally U-shape cross section. The cable guide 930 guides the cable from the reel through the cable path between the idler wheel 902 and the driven wheel 904. The cable guide 930 may be made of a low friction material such as UHMW. The U-shape allows the midpoint of the cable to be set down into the cable guide 930 without needing to feed a free terminal end of the cable therethrough. In order to provide sufficient traction, the idler wheel is mounted to a clamp 922. The clamp 922 comprises a riser 921 and a idler wheel mount arm 923. A tension bar 925 is mounted to the drive assembly plate such that the tension bar 925 can rotated up by turning handle 924 and be received by the first end of the idler wheel mount arm 923. Handle 924 pivots about pivot point 926. A nut is threadably mounted on the tensioner bar 925. The distance the nut travels along the tensioner bar 925 sets the amount of traction force between the driven wheel 904 and the idler wheel 902.

As shown in FIGS. 25-26, the motor assembly 920 is centrally positioned at a radial distance from the reel axle that extends between the first axle slot assembly 846 and the second axle slot assembly 809. The cable 993 (or other reelable material) is pulled off the reel 990 by means of the tractor drive mechanism. The tractor drive mechanism comprises the driven wheel 904 and the idler wheel 902, where the two wheels are in contact with one another and the cable 993 passes therebetween. The cable 993 is directed through a payout tube 942 to fall to the ground in to a figure eight pattern.

The cable dispensing mechanism is self-stowing inline with a lifting arm 8 for fast deployment when the cable 7 needs to be dispensed into a figure eight, as shown in FIG. 2. In FIG. 2, the reel 3 is oriented in a stored position where the reel 3 rests on the vehicle bed 20. The rewind/traction driven wheel 60 is shown engaged with the rim 5 of the reel 3. In the self-stowed position, the payout arm 400 and the primary arm 300 are vertically stacked parallel to the secondary lifting arm 8.

FIG. 3 depicts the lifting arms 2, 8 raised perpendicular to the vehicle bed 20. The adjustable frame 299 is shown in an extended configuration with the primary arm 300 horizontally oriented perpendicular to the lifting arm 8. The payout arm 400 is pivoted to a horizontal position perpendicular to the primary arm 300. The motor assembly 500 is mounted to the free moving distal end of the payout arm 400. The motor assembly 500 is centrally positioned at a radial distance from the reel axle that extends between the first axle slot assembly 130 and the second axle slot assembly 131.

An advantage of the modular design is that the self-stowing cable dispenser for figure eighting does not need to be purchased with the hydraulic bed. The self-stowing cable dispenser for figure eighting can be offered as an add-on kit. The kit may comprise: an adjustable frame 299 having a payout arm 400 pivotally mounted to a primary arm 300; a motor assembly 500 configured to be mounted to the distal end of the payout arm 400; a rail 325 configured to be mounted parallel to the secondary lifting arm 8; a slide 310 slidably mounted to the rail 325; a slide control 315 having a linear drive mechanism mounted to the rail 325 and operably connected to the slide 310; a motor assembly 500 sleeve.

Hydraulic cylinders are mounted to the frame below the bed surface. The hydraulic cylinders are mounted to the cross-member with a variety of linkages. A control valve can be mounted to a top body toolbox mounted at the back corner of the bed 20. The control valve can be fully proportional, giving the operator reliable, safe control of the reel, heavy materials or other equipment needed to be transported to and from the job site. Engine driven hydraulics are can be utilized to power the lift mechanism. Alternatively, electric driven hydraulic can be used to power the lift mechanism. Alternatively, power take off (PTO) driven hydraulic can be used to power the lift mechanism.

In one embodiment, a reel lift apparatus is used for lifting, securing, transporting, and unrolling a cable reel, wire reel, or other similarly shaped equipment. The reel lift apparatus can be used with ¾ ton pickup trucks. The reel lift apparatus allows for multi-purpose trucks to be outfitted for hauling a cable reel on the bed of truck, without the need for a separate trailer. The bed is designed to carry reels over the truck axle for maximum stability.

In one embodiment, the reel lift apparatus has a bed with arms that are pivotally mounted to the bed. The arms are configured to be pivoted such that the ends of the arms are lowered to engage the reel axle. To load the reel, the arms pivot up and toward the truck.

In one embodiment, the arms have an axle slot for receiving the reel axles. A reel axle engagement jaw opens and closes to lock the reel axle within the axle slot. A simple lever open mechanism allows for one-handed operation of the reel axle engagement jaw.

In one embodiment, as shown in FIG. 1, a receiver hitch 24 is mounted onto the vehicle bed 20. The receiver hitch 24 allows a variety of attachments or trailers to be used in collaboration with the reel lift and figure eight dispensing assembly.

In one embodiment, shown in FIG. 4, the rewind/traction driven wheel 60 is driven by motor 62. The motor 62 and rewind/traction driven wheel 60 are mounted to bracket 64. The bracket is mounted to carriage slide 70 to enable the rewind/traction driven wheel 60 to engage and disengage the rim 5. Carriage slide 70 slides along the longitudinal axis of lifting arm 2 by activating linear actuator 100 to move slide post 74 along the linear actuator 100. Once the rewind/traction driven wheel 60 engages the rim 5, the carriage slide 70 compresses spring 114 as nut 106 continues to move along the linear actuator 100. Spring 114 is compressed between nut 106 and end post 78.

In one embodiment, a vehicle-mounted cable dispensing apparatus for dispensing a cable from a reel having a reel axle, the vehicle-mounted cable dispensing apparatus is disclosed comprising:

a. a first lifting arm pivotally mounted to a vehicle and configured to pivotally move the reel through a plurality of pivot positions; and
b. a primary arm pivotally mounted to the first lifting arm and configured to rotationally move about the reel axle, the primary arm comprising:
   i. a distal end that is distal to the first lifting arm;
   ii. a secondary arm mounted to the distal end of the primary arm and configured to rotate between:
      1. a retracted secondary arm orientation wherein the secondary arm is parallel with the primary arm;
      2. an extended second arm orientation wherein the secondary arm is parallel with the reel axle;
c. a cable dispensing assembly mounted to a free end of the secondary arm.

Another tool can be mounted in place of the cable dispensing assembly. For example, a tensionmeter, such as a dynamometer, can be mounted to the free end of the secondary arm. A tensionmeter can be used to measure torque or tension applied by the motor to the cable. Fiber optic cables may be rated for a specific maximum tension. The tensionmeter can be mounted on the free end of the secondary arm with the cable dispensing assembly for tracking cable tension during dispensing in a figure eight. Alternatively, the tensionmeter can be mounted on the free end of the secondary arm to measure tension on the cable during retrieval using the retrieval unit.

In one embodiment, a vehicle-mounted cable dispensing apparatus for dispensing a cable from a reel having a reel axle is disclosed, the vehicle-mounted cable dispensing apparatus comprising:

a. a lifting arm mounted to the vehicle and configured to rotationally move the lifting arm through a plurality of lifting arm pivot positions;
b. an adjustable frame mounted directly to the lifting arm;
c. a motor assembly mounted to the adjustable frame and configured to payout the cable from the reel;
d. wherein the adjustable frame is configured to support the motor assembly in the following orientations:
   i. a stored orientation wherein the adjustable frame is inline with the lifting arm;
   ii. a dispensing orientation wherein the motor assembly is positioned near the horizontal center of the reel in any of the plurality of lifting arm pivot positions;
e. Optionally wherein the adjustable frame further comprises:
   i. a first rotational mount connecting the adjustable frame to the lifting arm;
   ii. a primary arm configured for rotational movement relative to the first rotational mount;
   iii. a payout arm mounted to the primary arm to swivel between being parallel with the lifting arm and parallel with the reel axle.
f. Optionally comprising:
   i. a payout tube extending from the motor assembly and configured to guide the cable;
   ii. an in-line jaw coupling between the payout arm and the motor assembly, wherein the in-line jaw coupling is configured to rotate the motor assembly such that the payout tube is parallel with the lifting arm.

In one embodiment, a method for a dispensing cable from a reel having a reel axle is disclosed, the method comprising:

a. aligning a first lifting arm, a primary arm, and a payout arm parallel with each other in a self-stowed configuration;
b. positioning a motor assembly in a payout configuration with the motor assembly is horizontally offset from the horizontal center of the reel by:
   i. lifting the reel by rotationally moving a first lifting arm, the reel being mounted to a free end of the first lifting arm;
   ii. Rotationally moving a primary arm about an axis parallel to the reel axle, wherein the primary arm is mounted to the free end of the first lifting arm;
   iii. Rotationally moving the motor assembly upon the payout arm, wherein the payout arm is mounted to the distal end of the primary arm that is distal to the first lifting arm; and
c. dispensing the cable from the reel.

It is understood that other embodiments will become readily apparent to those skilled in the art from the following detailed description, wherein various embodiments are shown and described by way of illustration only. As will be realized, the concepts are capable of other and different embodiments and their several details are capable of modification in various other respects, all without departing from the spirit and scope of what is claimed as the invention. Accordingly, the drawings and detailed description are to be regarded as illustrative in nature and not as restrictive.

We claim:

1. A vehicle-mounted cable-engaging apparatus for dispensing a cable from a reel having a reel axle, the vehicle-mounted cable-engaging apparatus comprising:

a. a first lifting arm pivotally mounted to a vehicle and configured to pivotally move the reel through a plurality of pivot positions;
b. a primary arm pivotally mounted to the first lifting arm and configured to rotate about an axis parallel to the reel axle, the primary arm comprising;
   i. a distal primary end that is distal to the first lifting arm;
   ii. a payout arm mounted near the distal primary end of the primary arm and configured to rotate between:
      a retracted secondary arm orientation wherein the payout arm is parallel with the primary arm;
      an extended payout arm orientation wherein the payout arm is parallel with the reel axle; and
c. a cable dispensing assembly mounted to a free end of the payout arm.

2. The vehicle-mounted cable-engaging apparatus of claim 1, further comprising:

a. a rail mounted parallel to the first lifting arm;
b. a slide mounted to the rail;
c. a support arm pivotally mounted to the slide and pivotally mounted to the primary arm; and
d. a linear actuator configured to move the slide upon the rail, whereby movement of the slide upon the rail causes the primary arm to rotate about the axis parallel to the reel axle.

3. The vehicle-mounted cable-engaging apparatus of claim 2, further comprising:

a. a motor assembly configured to drive the cable dispensing assembly.

4. The vehicle-mounted cable-engaging apparatus of claim 1, wherein the primary arm is configured to move with the first lifting arm.

5. The vehicle-mounted cable-engaging apparatus of claim 1, wherein the primary arm has a primary arm length the same as a first lifting arm length of the first lifting arm.

6. The vehicle-mounted cable-engaging apparatus of claim 1, further comprising:

a. a primary pivot mount pivotally connecting the primary arm to the first lifting arm, wherein the primary pivot mount comprises:
   i. a bracket having a hollow center portion and rounded side portions, whereby the primary arm rotates without creating a pinch point with the first lifting arm.

7. The vehicle-mounted cable-engaging apparatus of claim 1, further comprising:

a. a first pivot plate mounted to the distal primary end of the primary arm;
b. a second pivot plate mounted to a proximal payout end of the payout arm, wherein the second pivot plate is configured to rotate relative to the first pivot plate;
c. a twist lock plunger pin configured to lock the rotation of the second pivot plate relative to the first pivot plate;
d. a first set point configured to cooperate with the twist lock plunger pin to secure the payout arm in an inline stored configuration; and
e. a second set point configured to cooperate with the twist lock plunger pin to secure the payout arm in an extended configuration.

8. The vehicle-mounted cable-engaging apparatus of claim 7, wherein the payout arm is longitudinally extendable.

9. The vehicle-mounted cable-engaging apparatus of claim 1, wherein the payout arm comprises:

a. a first payout arm portion;
b. a payout tube terminal end portion; and c. an inline rotational coupling configured to rotate the payout tube terminal end portion relative to the first payout arm portion about a longitudinal axis of the payout arm.

10. A vehicle-mounted apparatus for engaging a cable from a reel, the vehicle-mounted apparatus comprising:

a. a lifting arm mounted to the vehicle and configured to rotationally move the lifting arm through a plurality of lifting arm pivot positions;

b. an adjustable frame mounted directly to the lifting arm;

c. wherein the adjustable frame is configured to support a motor assembly in the following orientations:

i. a self-stowed configuration wherein the adjustable frame is inline with the lifting arm; and ii. an extended configuration wherein the motor assembly is positioned near a horizontal center of the reel in any of the plurality of lifting arm pivot positions.

11. The vehicle-mounted apparatus of claim 10, wherein the adjustable frame further comprises:

a. a first rotational mount connecting the adjustable frame to the lifting arm;

b. a primary arm configured for rotational movement relative to the first rotational mount; and c. a payout arm mounted to the primary arm to swivel between being parallel with the lifting arm and parallel with an axis of rotation of the reel.

12. The vehicle-mounted apparatus of claim 11, further comprising:

a. a payout tube extending from the motor assembly and configured to guide the cable; and b. an in-line rotational coupling between the payout arm and the motor assembly and configured to rotate the motor assembly.

13. A method for engaging a cable from a reel, the method comprising:

a. mounting an adjustable frame to a first lifting arm, the adjustable frame having a first longitudinal axis and the first lifting arm having a second longitudinal axis;

b. storing the adjustable frame in a self-stowed configuration wherein the first longitudinal axis of the adjustable frame is vertically stacked parallel to the second longitudinal axis of the first lifting arm; and c. deploying the adjustable frame to align a distal frame end of the adjustable frame near a horizontal center of the reel in a plurality of lifting arm pivot positions.

14. The method of claim 13, wherein the adjustable frame further comprises a first primary arm and a payout arm.

15. The method of claim 14, further comprising the steps of:

a. aligning the first lifting arm, the first primary arm, and the payout arm parallel with each other in the self-stowed configuration.

16. The method of claim 14, further comprising the step of:

a. mounting a first pivot plate and a second pivot plate between the first primary arm and the payout arm;

b. securing the first primary arm parallel with the payout arm by cooperation of a twist lock plunger pin engaged with a first set point;

c. twisting the twist lock plunger pin to unlock the twist lock plunger pin;

d. rotating the second pivot plate relative to the first pivot plate; and e. securing the payout arm in an extended configuration by cooperation of the twist lock plunger pin engaged with a second set point.

17. The method of claim 13, further comprising the steps of:

a. lifting the reel by rotationally moving the first lifting arm, the reel being mounted to a free end of the first lifting arm;

b. rotationally moving a primary arm of the adjustable frame about an axis parallel to an axis of rotation of the reel, wherein the primary arm is mounted near the free end of the first lifting arm; and c. Rotationally moving a payout arm of the adjustable frame, wherein the payout arm is mounted to the primary arm.

18. The method of claim 17, further comprising the step of:

a. mounting a motor assembly to the distal frame end; and b. dispensing the cable from the reel.

19. The method of claim 18, further comprising the steps of:

a. securing a rotational position of the motor assembly with an inline rotational coupling that utilizes a latch mechanism to prevents a cross member from moving along a longitudinal axis of the payout arm, which maintains a plurality of teeth of a first jaw portion engaged with a plurality of valley portions of a second jaw portion; and b. when deploying the adjustable frame, the latch mechanism is disengaged thereby allowing the cross member to move in the longitudinal axis of the payout arm, whereby a payout tube terminal end portion can be in-line rotated relative to a first payout arm portion.

20. The method of claim 19, wherein the plurality of teeth of the first jaw portion cooperates with the plurality of valley portions of the second jaw portion under a biasing force of a spring to provide a plurality of discrete rotation positions through which the inline rotational coupling may be secured.

* * * * *